US009779925B2

(12) United States Patent
Kinoshita et al.

(10) Patent No.: US 9,779,925 B2
(45) Date of Patent: Oct. 3, 2017

(54) COUPLING DEVICE FOR MASS SPECTROMETRY APPARATUS

(71) Applicant: BIOCHROMATO, INC., Fujisawa-shi, Kanagawa (JP)

(72) Inventors: Kazumasa Kinoshita, Fujisawa (JP); Yuki Kudo, Fujisawa (JP); Takao Nishiguchi, Fujisawa (JP)

(73) Assignee: BIOCHROMATO, INC., Fujisawa-Shi (JP)

( * ) Notice: Subject to any disclaimer, the term of this patent is extended or adjusted under 35 U.S.C. 154(b) by 0 days.

(21) Appl. No.: 15/386,790

(22) Filed: Dec. 21, 2016

(65) Prior Publication Data

US 2017/0103878 A1 Apr. 13, 2017

Related U.S. Application Data

(63) Continuation of application No. 15/227,449, filed on Aug. 3, 2016, now Pat. No. 9,570,278, which is a (Continued)

(30) Foreign Application Priority Data

Feb. 4, 2014 (JP) ..... 2014-019669

(51) Int. Cl.
*H01J 49/00* (2006.01)
*H01J 49/04* (2006.01)

(52) U.S. Cl.
CPC ..... *H01J 49/0422* (2013.01); *H01J 49/0027* (2013.01)

(58) Field of Classification Search
CPC ..... H01J 49/0422; H01J 49/0027
(Continued)

(56) References Cited

U.S. PATENT DOCUMENTS 8,592,758 B1 * 11/2013 Nilles ..... H01J 49/0431 250/288
2005/0196871 A1 9/2005 Cody et al.
2016/0056029 A1 2/2016 Qiu

FOREIGN PATENT DOCUMENTS

JP 2008-051504 A 3/2008
JP 2008051504 A * 3/2008
(Continued)

OTHER PUBLICATIONS

Osuga, J., Konuma, K., "Applications of Direct Analysis in Real Time (DART) Mass Spectrometry" (2011) Journal of Synthetic Organic Chemistry Japan, vol. 69, No. 2, 171-175.
(Continued)

*Primary Examiner* — Michael Maskell
(74) *Attorney, Agent, or Firm* — Westman, Champlin & Koehler, P.A.; Z. Peter Sawicki; Amanda M. Prose

(57) ABSTRACT

An object of the present invention is to provide a technology that enables highly sensitive atmospheric-pressure real-time mass spectrometry of a volatile substance. The present invention provides a coupling device for a mass spectrometry apparatus that is an interface member to be connected to an atmospheric-pressure real-time mass spectrometry apparatus, the coupling device including (A) an excitation gas introducing port, a sample gas introducing port, and an ionized sample gas discharging port, and (B) a channel through which the excitation gas introducing port and the ionized sample gas discharging port are in communication, and (C) a space for mixing excitation gas and sample gas being formed in a region of a portion of the channel recited in (B), by the coupling device having a structure in which the sample gas introducing port and the channel recited in (B) are in communication.

5 Claims, 22 Drawing Sheets

Related U.S. Application Data continuation of application No. PCT/JP2015/052978, filed on Feb. 3, 2015.

(58) Field of Classification Search
USPC ..... 250/281, 282, 288
See application file for complete search history.

(56) References Cited

FOREIGN PATENT DOCUMENTS

| | | | |
|---|---|---|---|
| JP | 2013-545243 | A | 12/2013 |
| WO | 2004098743 | A2 | 11/2004 |
| WO | 2012090915 | A1 | 7/2012 |

OTHER PUBLICATIONS

Kikura-Hanajiri, "Simple and Rapid Screening for Target Compounds using Direct Analysis in Real Time (DART)-MS" (2010) FFI Journal, vol. 215, No. 2, 137-143.

Cody et al., "Versatile New Ion Source for the Analysis of Materials in Open Air under Ambient Conditions" (2005) Anal. Chem., vol. 77, No. 8, 2297-2302.

Takats et al., "Mass Spectrometry Sampling Under Ambient Conditions with Desorption Electrospray Ionization" (2004) Science, vol. 306, 471-473.

International Search Report for related PCT application No. PCT/JP2015/052978, dated Mar. 3, 2015.

Extended European Search Report issued for related EP application No. 15746897.6 dated Mar. 9, 2017.

* cited by examiner

COUPLING DEVICE FOR MASS SPECTROMETRY APPARATUS

CROSS REFERENCE TO RELATED APPLICATION

The present application is a continuation of and claims priority to U.S. patent application Ser. No. 15/227,449, filed Aug. 3, 2016, which is a continuation of and claims priority of PCT/JP2015/052978, filed Feb. 3, 2015, which claims priority of Japanese Patent Application No. 2014-019669, filed Feb. 4, 2014, the contents of which are hereby incorporated by reference in their entireties.

TECHNICAL FIELD

The present invention relates to a coupling device for a mass spectrometry apparatus that enables highly sensitive atmospheric-pressure real-time mass spectrometry of a volatile substance. Also, the present invention relates to a mass spectrometry method for performing highly sensitive atmospheric-pressure real-time mass spectrometry of a volatile substance.

BACKGROUND ART

A mass spectrometry method is a technique that is widely used as a means for analyzing various substances in many technical fields. Given the great demand for mass spectrometry, ionization methods for ionizing samples are under development, thus increasing the applicability of mass spectrometry to various samples, and making it possible to analyze a large variety of substances.

However, many conventional mass spectrometry methods require a special space (closed environment) for ionizing an analysis sample under conditions such as a high temperature, a vacuum, a high voltage, laser irradiation, and the like. That is, in principle, it is necessary to seal a sample in a sealed ionization chamber and ionize the sample, and these methods place significant restrictions on performing sample analysis (see Non-Patent Documents 1 and 2, for example).

In such a situation, new technologies such as the DART method and the DESI method have been developed as ionization methods that can achieve real-time direct ionization of a sample under ambient conditions (see Non-Patent Documents 1 to 4, for example).

Here, the DART (direct analysis in real time) method is a method in which an interaction between molecules (particularly water molecules) in the atmosphere and a sample is induced by discharging excitation gas at the sample under the atmospheric environment to ionize the sample. The DART method is an excellent method with which the sample can be directly ionized merely by being held close to an ion source in an open system.

The DESI (desorption electrospray ionization) method is a method in which electrically charged minute droplets of a solvent for ionization are attached to the surface of a sample by spraying the solvent onto the surface of the sample using a capillary to which voltage is applied, and mass spectrometry is performed on the ionized sample desorbed from the surface of the sample at that time.

Although the DART method and the DESI method are excellent methods that enable atmospheric-pressure real-time mass spectrometry, there is a disadvantage in that these methods are unsuitable for analysis of a volatile substance in principle.

These methods are methods in which ionization is performed in an open system and thus there is an inherent fundamental problem that if a volatile substance is analyzed, the ionized sample is scattered by diffusion or the like because of the structure of an apparatus, resulting in a marked decrease in detection sensitivity.

As described above, with the mass spectrometry methods using an ion source of conventional technologies, there is no technique for analyzing a volatile substance with a high sensitivity in real time under ambient conditions.

As a technique of a conventional technology for improving the detection sensitivity of a volatile substance, the only means is to analyze a gaseous sample or the like collected in a collection bottle, a sampling bag, or the like during a certain period of time, and therefore, a technique for analyzing a volatile substance with a high sensitivity "in real time under ambient conditions" has been anticipated. Moreover, it is desired that this analysis can be realized with a simple operation.

It should be noted that there is a technique in which a volatile substance is analyzed by gas chromatography (GC method) as a mass spectrometry method that enables highly sensitive analysis, but it requires pretreatment of the sample and a long measurement time (specifically one hour or more), and thus real-time analysis is not possible.

CITATION LIST

Patent Documents

Patent Document 1: JP 2013-545243A (Improvements in Mass Spectrometry Method and Improvements Relating to Mass Spectrometry Method)

Non-Patent Documents

Non-Patent Document 1: Journal of Synthetic Organic Chemistry, Japan, Vol. 69 No. 2 pp. 171-175 (2011); Junichi Osuga, Kiyotaka Konuma; Applications of Direct Analysis in Real Time (DART) Mass Spectrometry Non-Patent Document 2: Foods & Food Ingredients J. Jpn., Vol. 215, No. 2, pp. 137-143 (2010); Ruri Kikura-Hanajiri; Simple and Rapid Screening for Target Compounds Using Direct Analysis in Real Time (DART)-MS Non-Patent Document 3: Anal. Chem. 15; 77(8): pp. 2297-2302 (2005); Cody R B, Laramée J A, Durst H D.; Versatile new ion source for the analysis of materials in open air under ambient conditions.

Non-Patent Document 4: Science, 2004, Vol. 306, Iss. 5695, pp. 471-473; Zoltán Takáts, Justin M. Wiseman, Bogdan Gologan, and R. Graham Cooks; Mass Spectrometry Sampling Under Ambient Conditions with Desorption Electrospray Ionization.

SUMMARY OF INVENTION

Technical Problem

It is an object of the present invention to provide a technology that solves the above-mentioned problems of the conventional technologies and enables highly sensitive atmospheric-pressure real-time mass spectrometry of a volatile substance.

Solution to Problem

As a result of intensive research, the inventors of the present invention found a means for solving the above-mentioned problems.

(1) It was found that in a mass spectrometry apparatus with which a sample can be analyzed in real time under ambient conditions, detection sensitivity of a volatile substance can be significantly enhanced in atmospheric-pressure real-time mass spectrometry by connecting, between an excitation gas ejecting port of an ion source and an ionized sample gas collecting port of a mass spectrometer, a coupling device configured to have an excitation gas introducing port, a sample gas introducing port, an ionized sample gas discharging port, and a space for mixing the excitation gas and the sample gas.

(2) The inventors of the present invention found from the findings mentioned in (1) above that the atmospheric-pressure real-time mass spectrometry of the volatile substance can be performed with a significantly high sensitivity by using the mass spectrometry apparatus to which the above-mentioned coupling device is connected.

(3) Furthermore, the inventors of the present invention found that the detection sensitivity can be further enhanced by forming an outside air introducing port in the coupling device and causing a channel extending from the outside air introducing port to be in communication with a main channel inside the coupling device.

It should be noted that the coupling device is a general-purpose member that can be shaped so as to be capable of being connected to a commercially available atmospheric-pressure real-time mass spectrometry apparatus and thus can be easily attached to and detached from the commercially available apparatus. Therefore, highly sensitive real-time mass spectrometry can be easily realized.

The atmospheric-pressure real-time mass spectrometry method using the coupling device is a technique that requires no sample pretreatment in principle and that can detect a volatile substance in real time.

The present invention was arrived at based on the above-mentioned findings and specifically relates to aspects of the invention described below.

[1] A coupling device for a mass spectrometry apparatus that is an interface member to be connected to an atmospheric-pressure real-time mass spectrometry apparatus, the coupling device including (A) an excitation gas introducing port, a sample gas introducing port, and an ionized sample gas discharging port; (B) a channel through which the excitation gas introducing port and the ionized sample gas discharging port are in communication; (C) a space for mixing excitation gas and sample gas being formed in a region of a portion of the channel recited in (B), by the coupling device having a structure in which the sample gas introducing port and the channel recited in (B) are in communication; and (D) an outside air introducing port, and having a structure in which a channel from the outside air introducing port is in communication with the channel recited in (B).

[2] The coupling device for a mass spectrometry apparatus according to [1] above, wherein the coupling device is an interface member for being connected between an excitation gas ejecting port of an ion source using a principle of a DART method and an ionized sample gas collecting port of a mass spectrometer.

[3] The coupling device for a mass spectrometry apparatus according to [1] or [2] above, wherein the space recited in (C) is a space formed in a channel portion having a linear-tube shape in the channel recited in (B).

[4] The coupling device for a mass spectrometry apparatus according to any of [1] to [3] above, wherein the space recited in (C) is a space formed such that a cross-sectional area of the channel recited in (B) on the excitation gas introducing port side is relatively large compared with the channel on the ionized sample gas discharging port side.

[5] The coupling device for a mass spectrometry apparatus according to any of [1] to [4] above, which has a structure in which the channel extending from the outside air introducing port recited in (D) is in communication with the channel recited in (B) at a position on the ionized sample gas discharging port side with respect to the space recited in (C).

[6] An atmospheric-pressure real-time mass spectrometry apparatus provided with the coupling device for a mass spectrometry apparatus according to any of [1] to [5] above.

[7] A mass spectrometry method for performing mass spectrometry of a volatile substance in real time under ambient conditions, which uses the atmospheric-pressure real-time mass spectrometry apparatus according to [6] above.

It should be noted that Patent Document 1 describes a member as a technology relating to a sampling interface of a mass spectrometry apparatus.

However, this interface member is a member dedicated to a plasma mass spectrometry apparatus (ICP) for performing "analysis of an inorganic element". Here, as shown in FIG. 6, the plasma mass spectrometry apparatus (ICP) is an apparatus having a principle of atomizing a solvent sample 64 by a pretreatment and exciting the elements of the sample (ionizing the sample at an element level) by the action of plasma in a plasma field 63.

The interface member 61 mentioned in Patent Document 1 is a member that is connected and installed downstream of the plasma field 63 in an ICP torch 62, and that is used for the purpose of retarding the electron mobility to improve the measurement sensitivity by applying additional electric potential to the excited elements (ionized sample).

As shown by this principle, the ionized sample (excited element sample) 65 is introduced into the interface member in Patent Document 1, and there is no "space in which the sample gas and the excitation gas are mixed" as formed in the coupling device according to the present invention.

Furthermore, since it is necessary to supply the solvent sample 64 as a sample in the plasma mass spectrometry apparatus (ICP), atmospheric-pressure real-time mass spectrometry cannot be realized in principle.

As is clear from these points, the interface member in Patent Document 1 has a structure, and operations and functions that are completely different from those of the coupling device according to the present invention.

Advantageous Effects of the Invention

With the present invention, it is possible to realize highly sensitive atmospheric-pressure real-time mass spectrometry of a volatile substance.

BRIEF DESCRIPTION OF DRAWINGS

FIG. 7A is a diagram showing the result of the analysis (test 1-1) performed using the apparatus to which the coupling device is connected. The vertical axis indicates the peak intensity, and the horizontal axis indicates the m/z value.

In FIG. 7A and FIG. 7B, the vertical axis indicates the peak intensity, and the horizontal axis indicates the m/z value.

FIG. 8A is a diagram showing the result of the analysis (test 1-3) performed using the apparatus to which the coupling device is connected. The vertical axis indicates the peak intensity, and the horizontal axis indicates the m/z value.

In FIG. 8A and FIG. 8B, the vertical axis indicates the peak intensity, and the horizontal axis indicates the m/z value.

FIG. 9A is a diagram showing the result of the analysis (test 1-5) performed using the apparatus to which the coupling device is connected.

In FIG. 9A and FIG. 9B, the vertical axis indicates the peak intensity, and the horizontal axis indicates the m/z value.

FIG. 10A is a diagram showing the result of the analysis (test 2-1) performed using the apparatus to which the coupling device with an outside air introducing mechanism is connected.

Figure 10A:
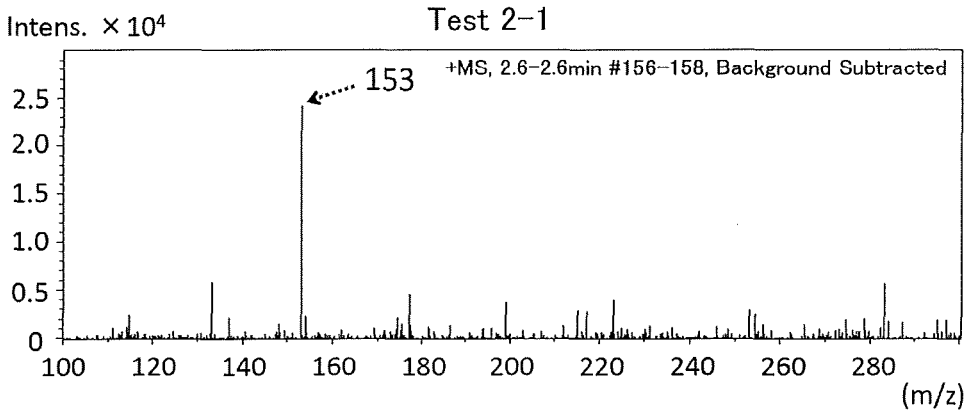
FIG. 10A is a mass chromatogram obtained by performing DART-MS mass spectrometry of Vanillin supplied as a volatile substance sample in Example 2. Specifically.
Figure 10B:
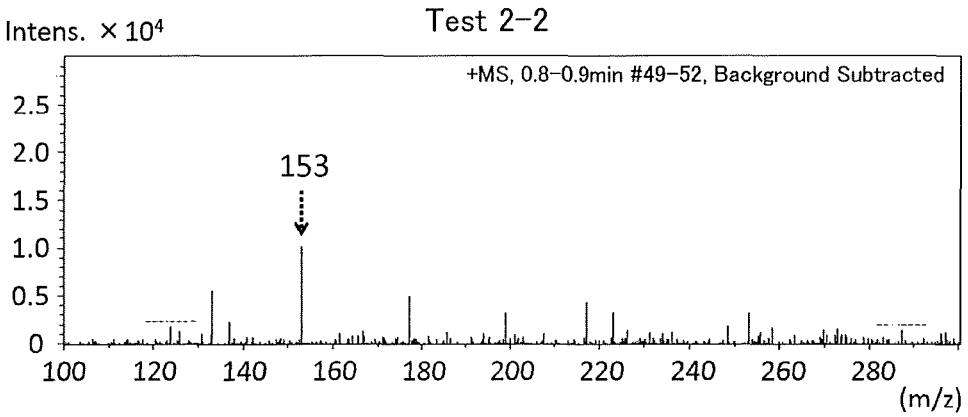
FIG. 10B is a diagram showing the result of the analysis (test 2-2) performed using the apparatus to which the coupling device without an outside air introducing mechanism is connected in Example 2.

In both FIG. 10A and FIG. 10B, the vertical axis indicates the peak intensity, and the horizontal axis indicates the m/z value.

Figure 11:
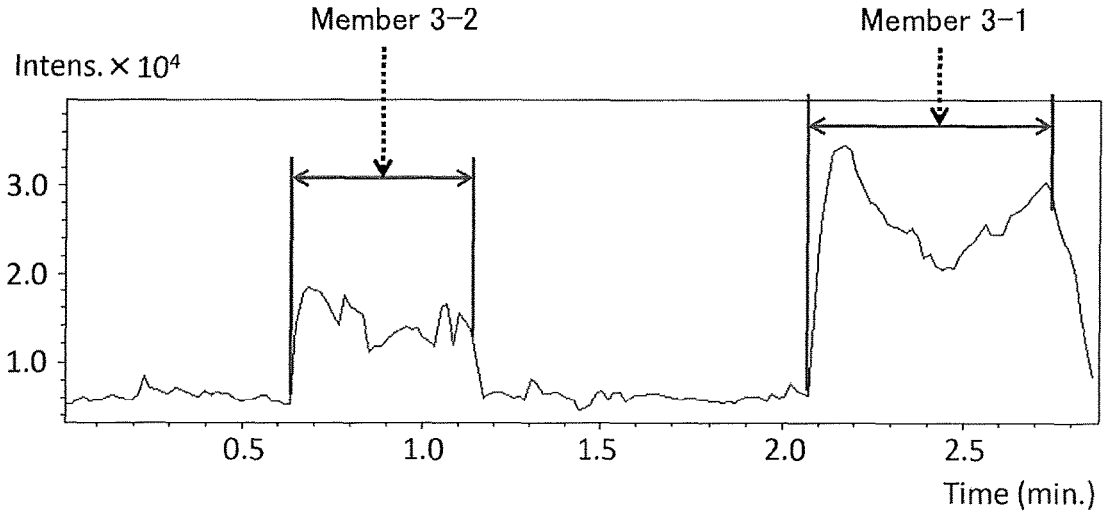

FIG. 11 is a diagram showing an extraction ion chromatogram (EIC) obtained by performing DART-MS mass spectrometry of Vanillin supplied as a volatile substance sample in Example 3. In this diagram, the vertical axis indicates the peak intensity, and the horizontal axis indicates the measurement time.

Figure 12A:
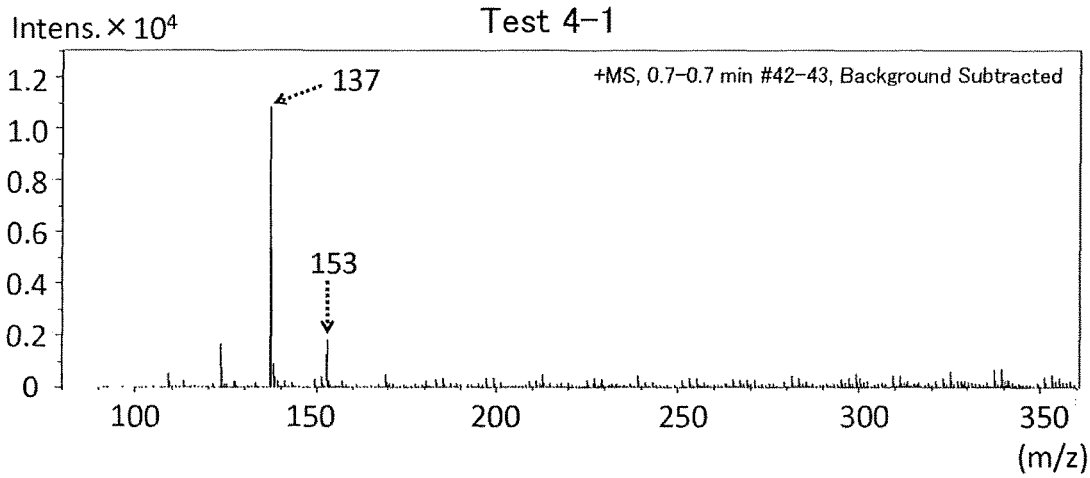

FIG. 12A is a mass chromatogram obtained by performing DART-MS mass spectrometry (test 4-1) of dark chocolate supplied as an analysis sample in Example 4.

Figure 12B:
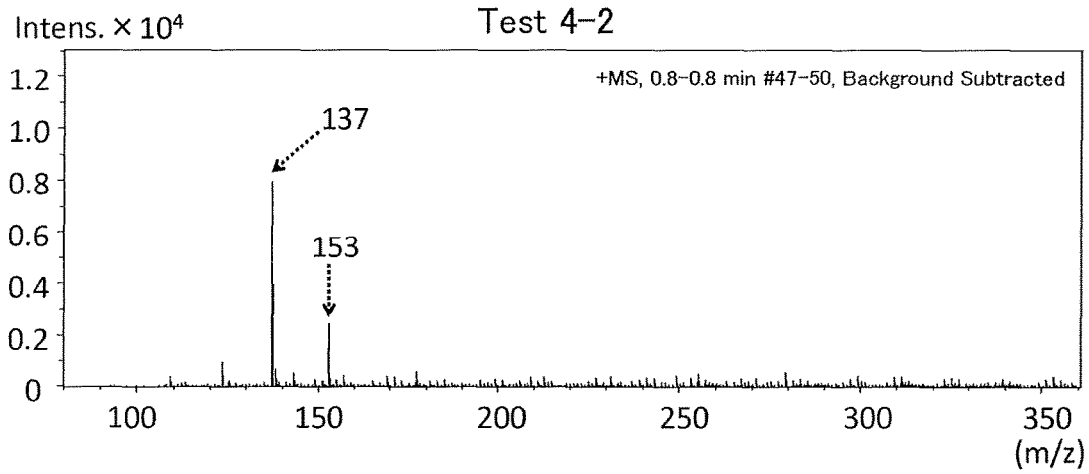

FIG. 12B is a mass chromatogram obtained by performing DART-MS mass spectrometry (test 4-2) of milk chocolate supplied as an analysis sample in Example 4.

In both FIG. 12A and FIG. 12B, the vertical axis indicates the peak intensity, and the horizontal axis indicates the m/z value.

Figure 13:
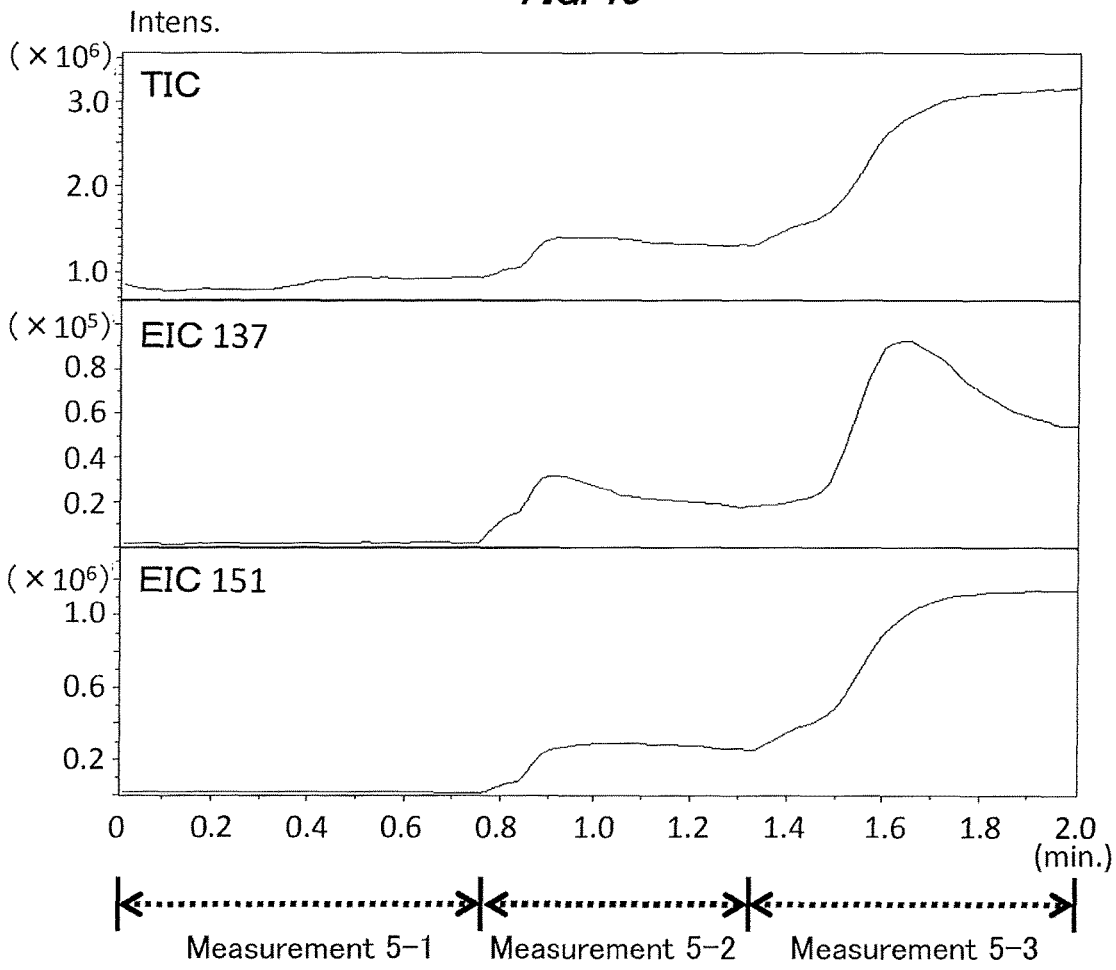

FIG. 13 is a diagram showing an extraction ion chromatogram (EIC) obtained by analyzing the behavior of volatile substances in a case where spearmint chocolate is melted in a hot water bath in Example 5. In this diagram, the vertical axis indicates the peak intensity, and the horizontal axis indicates the measurement time. TIC, EIC 137, and EIC 151 in the diagram indicate a total ion chromatogram, an extraction ion chromatogram of m/z=137, and an extraction ion chromatogram of m/z=151, respectively.

Figure 14:
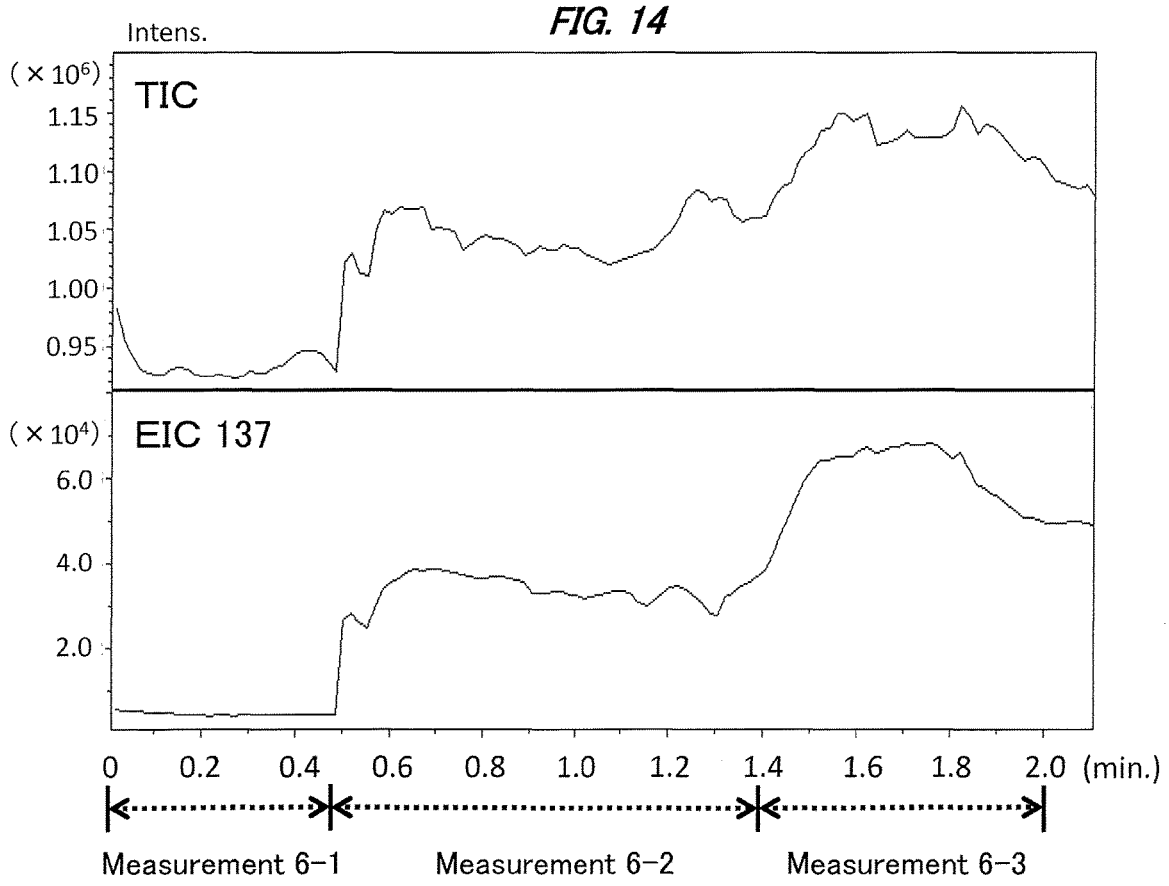

FIG. 14 is a diagram showing an extraction ion chromatogram (EIC) obtained by analyzing the behavior of volatile substances in a case where an orange-flavored cookie is crushed in Example 6. In this diagram, the vertical axis indicates the peak intensity, and the horizontal axis indicates the measurement time. TIC and EIC 137 in the diagram indicate a total ion chromatogram and an extraction ion chromatogram of m/z=137, respectively.

Figure 15:
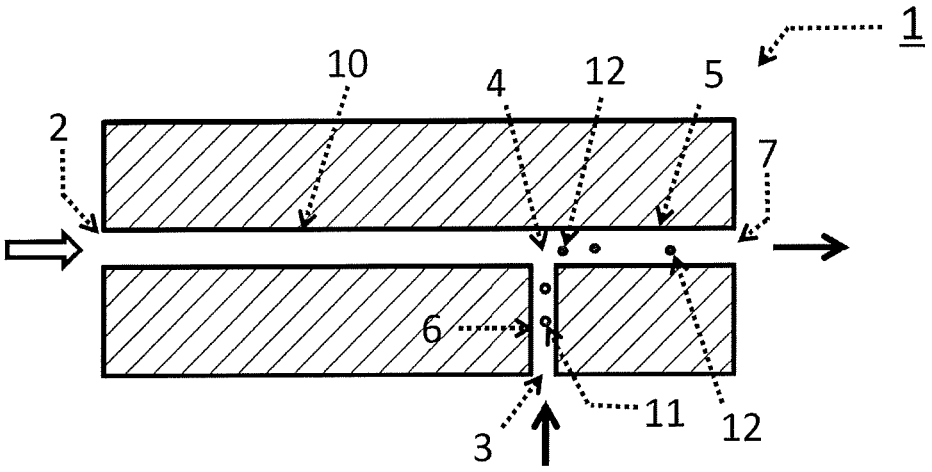

FIG. 15 is a longitudinal cross-sectional view of one mode of the sensitivity enhancing coupling device according to the present invention when viewed from the front side. The hatched region indicates a support structure portion of the coupling device. The thick arrows shown in the diagram indicate the flow of sample gas or ionized sample gas. The hollow arrow indicates the flow of excitation gas.

Figure 16:
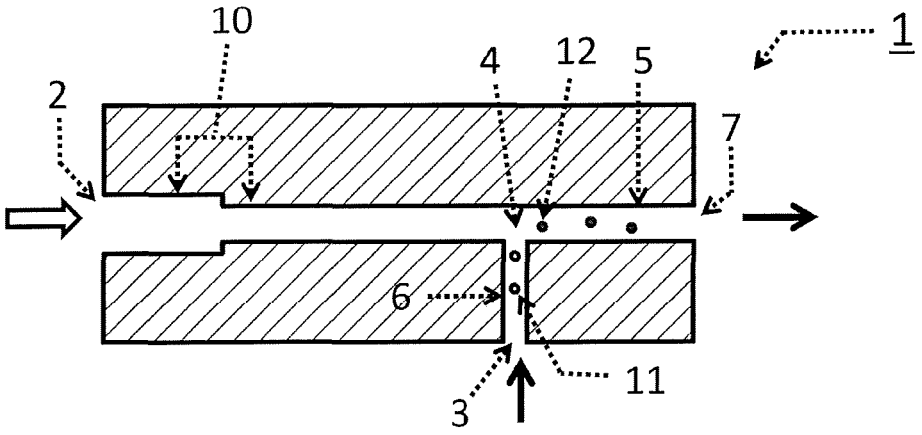

FIG. 16 is a longitudinal cross-sectional view of one mode of the sensitivity enhancing coupling device according to the present invention when viewed from the front side. The hatched region indicates a support structure portion of the coupling device. The thick arrows shown in the diagram indicate the flow of sample gas or ionized sample gas. The hollow arrow indicates the flow of excitation gas.

Figure 17:
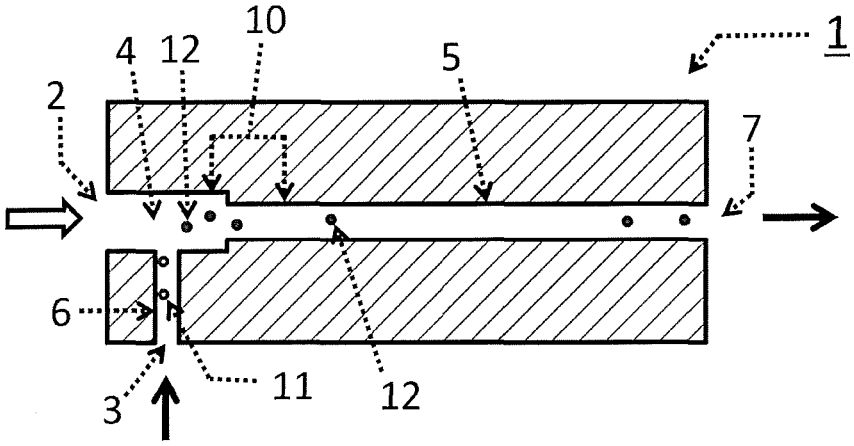

FIG. 17 is a longitudinal cross-sectional view of one mode of the sensitivity enhancing coupling device according to the present invention when viewed from the front side. The hatched region indicates a support structure portion of the coupling device. The thick arrows shown in the diagram indicate the flow of sample gas or ionized sample gas. The hollow arrow indicates the flow of excitation gas.

Figure 18:
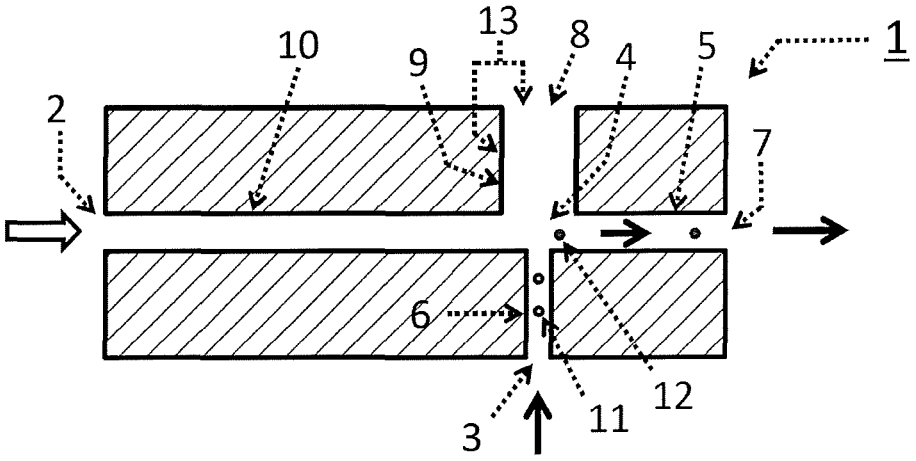

FIG. 18 is a longitudinal cross-sectional view of one mode of the sensitivity enhancing coupling device according to the present invention when viewed from the front side. The hatched region indicates a support structure portion of the coupling device. The thick arrows shown in the diagram indicate the flow of sample gas or ionized sample gas. The hollow arrow indicates the flow of excitation gas.

Figure 19:
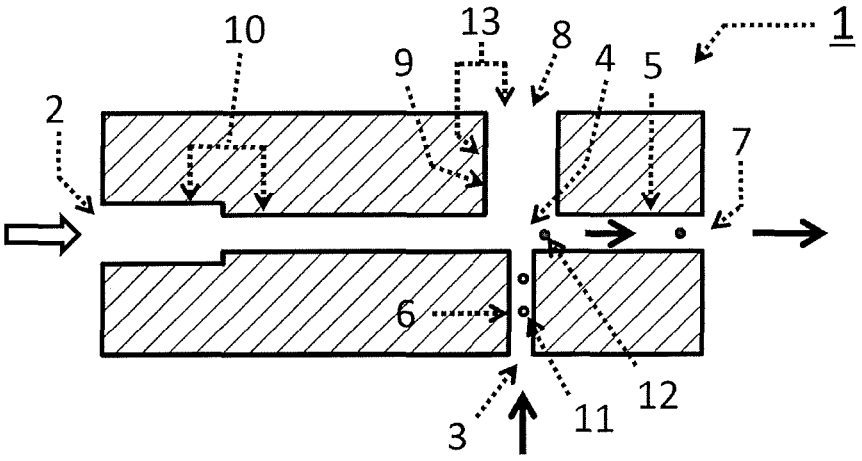

FIG. 19 is a longitudinal cross-sectional view of one mode of the sensitivity enhancing coupling device according to the present invention when viewed from the front side. The hatched region indicates a support structure portion of the coupling device. The thick arrows shown in the diagram indicate the flow of sample gas or ionized sample gas. The hollow arrow indicates the flow of excitation gas.

Figure 20:
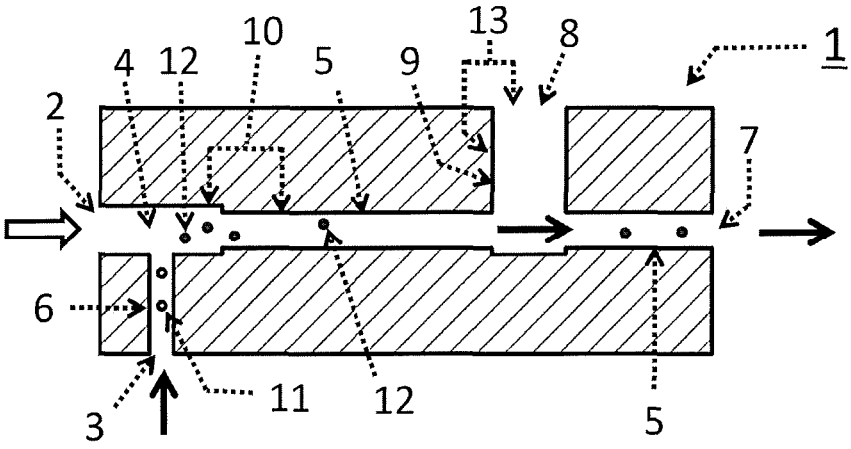

FIG. 20 is a longitudinal cross-sectional view of one mode of the sensitivity enhancing coupling device according to the present invention when viewed from the front side. The hatched region indicates a support structure portion of the coupling device. The thick arrows shown in the diagram indicate the flow of sample gas or ionized sample gas. The hollow arrow indicates the flow of excitation gas.

Figure 21A:
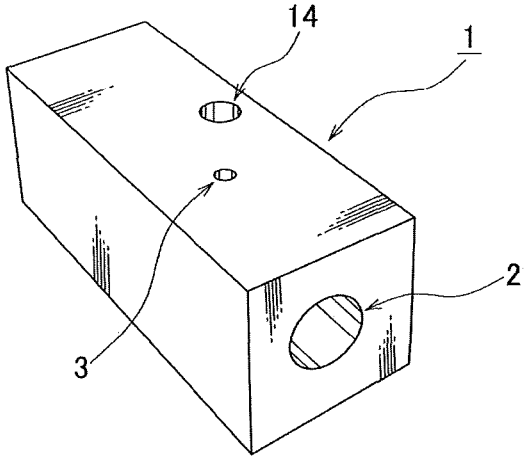
Figure 21B:
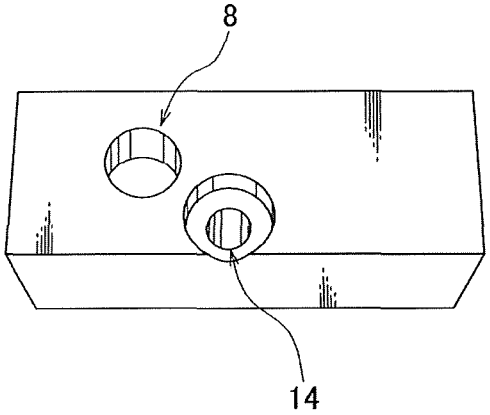

FIG. 21A is a photographic image of a sensitivity enhancing coupling device produced in Example 7. This diagram is a photographic image when obliquely viewed from the upper-lateral side in the direction of a sample gas introducing port 2. FIG. 21B is a photographic image when slightly obliquely viewed from the upper side.

Figure 22A:
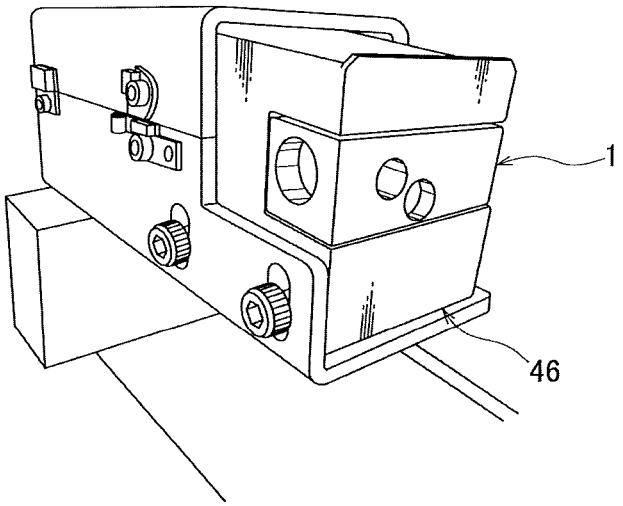
Figure 22B:
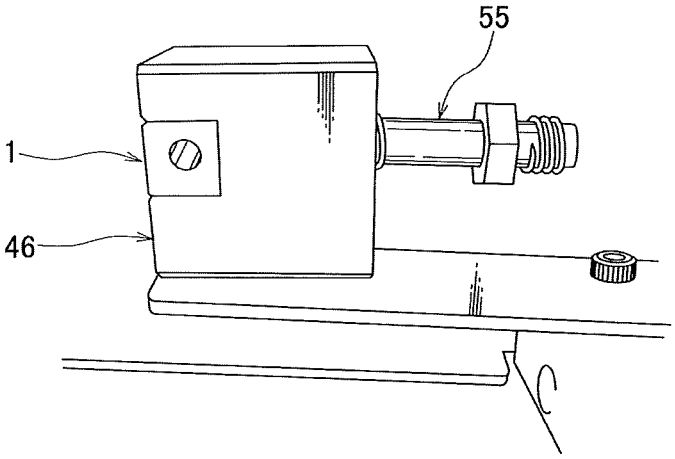

FIG. 22A is a photographic image showing a state in which the sensitivity enhancing coupling device produced in Example 7 is attached to an adapter member for connecting the coupling device to a mass spectrometry apparatus. This diagram is a photographic image when viewed from the lateral-front side. FIG. 22B is a photographic image when viewed from the lateral side.

DESCRIPTION OF EMBODIMENTS

The present application claims priority based on JP 2014-019669, which was filed in Japan on Feb. 4, 2014, by the applicant of the present invention and is incorporated hereby by reference in its entirety.

Hereinafter, embodiments of the present invention will be described in detail.

The present invention relates to a coupling device for a mass spectrometry apparatus that enables highly sensitive atmospheric-pressure real-time mass spectrometry of a volatile substance.

Also, the present invention relates to a method for performing highly sensitive atmospheric-pressure real-time mass spectrometry of a volatile substance.

1. Sensitivity Enhancing Coupling Device

A coupling device 1 according to the present invention is an interface member that is to be connected to an atmospheric-pressure real-time mass spectrometry apparatus 21. The coupling device is connected between an excitation gas ejecting port 32 of an ion source and an ionized sample gas collecting port 42 of a mass spectrometer and used.

Connecting the coupling device to an atmospheric-pressure real-time mass spectrometry apparatus makes it possible to dramatically enhance the sensitivity of mass spectrometry (a peak value of a mass chromatogram). That is, the coupling device according to the present invention is a sensitivity enhancing coupling device for an atmospheric-pressure real-time mass spectrometry apparatus.

The coupling device according to the present invention is a coupling device having a sensitivity enhancing function for an atmospheric-pressure real-time mass spectrometry apparatus. The coupling device for a mass spectrometry apparatus 1 according to the present invention can be expressed as a "coupling device", a "coupling device for a mass spectrometry apparatus", a "sensitivity enhancing coupling device", an "interface member", a "coupling member", a "coupling member for a mass spectrometry apparatus", a "sensitivity enhancing coupling member", or the like. All these terms can be used as a term that refers to the coupling device 1 according to the present invention.

Examples of the coupling device according to the present invention are shown in FIGS. 1 to 3 and 15 to 21. It should be noted that the present invention is not limited to these modes.

Main Structure of Coupling Device

The coupling device 1 according to the present invention is a member including an excitation gas introducing port 2, a sample gas introducing port 3, and an ionized sample gas discharging port 7.

In the coupling device 1, the excitation gas introducing port 2 and the ionized sample gas discharging port 7 are in communication, and a coupling-device main channel 10 is formed. It is preferable that at least a portion of the coupling-device main channel 10 has a linear-tube shape. Furthermore, it is desirable that the entire channel has a linear-tube shape.

It should be noted that the term "linear-tube shape" used herein refers to a shape of a tube that extends substantially linearly without curving. The shape of a cross section of the tube includes a circular shape and an annular shape as well as a polygonal shape and a polygonal annular shape.

The coupling-device main channel 10 is partially constituted by an excitation gas-sample gas mixing space 4 and an ionized sample gas channel 5.

The coupling device 1 has a structure in which a sample gas introducing channel 6 that extends from the sample gas introducing port 3 is in communication with the coupling-device main channel 10. With this structure, the excitation gas-sample gas mixing space 4 is formed in the region of a portion of the coupling-device main channel 10.

It is preferable that the excitation gas-sample gas mixing space 4 is formed in a portion having a linear-tube shape in the coupling-device main channel 10.

Outline Shape

Any outline shape can be adopted as the entire outline shape of the coupling device 1 as long as the coupling device is a structure that satisfies the above-mentioned main structure.

It is desirable that the outline shape is pillar-like or substantially pillar-like shape in order to secure the excitation gas-sample gas mixing space 4 and the ionized sample gas channel 5 each having a certain channel length. A laid-down shape is particularly desirable.

Examples of pillar-like or substantially pillar-like shapes include shapes obtained by laying down a columnar shape, a barrel shape, a prismatic shape (e.g., triangular prismatic, quadrangular prismatic, or hexagonal prismatic), a polygonal annular pillar-like shape, an entasis pillar-like shape (a pillar-like shape whose central portion bulges), a reverse entasis pillar-like shape (a pillar-like shape whose central portion is sunken), a truncated circular conical shape, a truncated pyramid-like shape (e.g., truncated triangular pyramid-like, truncated quadrangular pyramid-like, or truncated hexagonal pyramid-like), and a trapezoidal pillar-like shape. These shapes include a shape in which the pillar length (the length of the horizontal axis) is shorter than the width of the cross section (the length of the vertical axis). That is, the shapes include a cube-like shape, a stump-like shape, and the like.

Shapes that are substantially equivalent to these shapes can also be included. Shapes obtained by combining the shapes listed above can also be adopted as the outline shape of the coupling device 1.

A tubular shape, a cylindrical shape, a box-like shape, or the like obtained by reducing the thickness of a support portion can also be adopted as the outline shape. The outline shape of a branched tubular shape (branched tube shape) obtained by combining a plurality of tubular structures can also be adopted.

It should be noted that a "tubular shape" and a "tube shape" used herein include not only tubes that are circular or annular in cross section but also tubes that are polygonal and polygonal annular in cross section.

Moreover, a spherical shape, a prolate spheroid shape, and the like can also be adopted as the outline shape. Shapes obtained by combining the shapes listed above can also be adopted as the outline shape of the coupling device 1.

It is preferable that the entire length of the outline shape of the coupling device 1 (the length in a direction of the coupling-device main channel 10; the pillar length or the tube length for the coupling device having a pillar-like shape, a substantially pillar-like shape, a tubular shape, a cylindrical shape, or the like) is set to about 5 to 120 mm, for example, in order to secure the excitation gas-sample gas mixing space 4 and the ionized sample gas channel 5 each having a certain channel length.

It is preferable that the lower limit of the length of the outline shape is set to 5 mm or more, preferably 10 mm or more, more preferably 15 mm or more, even more preferably 20 mm or more, and even more preferably 25 mm or more.

There is no particular limitation on the upper limit of the length of the outline shape as long as ionized sample gas 12 can reach the ionized sample gas collecting port 42 of the mass spectrometer in a state in which its ionization state is retained (within one second at most; preferably within 500 milliseconds). The upper limit can be set to 120 mm or less, preferably 100 mm or less, more preferably 80 mm or less, even more preferably 60 mm or less, even more preferably 50 mm or less, even more preferably 45 mm or less, even more preferably 40 mm or less, and even more preferably 35 mm or less, for example.

There is no particular limitation on the width of the outline shape of the coupling device 1 (the width of the cross section taken orthogonal to the direction of the coupling-device main channel 10; the width of the cross section for the coupling device having a pillar-like shape, a substantially pillar-like shape, a tubular shape, a cylindrical shape, or the like) as long as the excitation gas-sample gas mixing space 4 having a certain volume can be secured, and a supporting material that maintains the strength of the coupling device can be secured. The width of the outline shape can be set to about 5 to 80 mm, for example.

The upper limit of the width of the outline shape can be set to 5 mm or more, preferably 6 mm or more, more preferably 8 mm or more, even more preferably 10 mm or more, and even more preferably 12 mm or more.

The lower limit of the width of the outline shape can be set to 80 mm or less, preferably 50 mm or less, more preferably 40 mm or less, even more preferably 30 mm or less, even more preferably 25 mm or less, and even more preferably 20 mm or less.

Material

There is no particular limitation on the material constituting a support of the coupling device 1 as long as the material has sufficient strength, and any material can be used. Examples thereof include a resin, a ceramic, a metal, a mineral, and glass. It is preferable that the member is made of an insulating material.

In particular, when DART is used as the ion source, it is preferable to use a material that additionally has heat resistance. Here, specifically, it is preferable to use a material that has heat resistance of 200° C. or more, preferably 250° C. or more, more preferably 300° C. or more, even more preferably 320° C. or more, even more preferably 340° C. or more, even more preferably 360° C. or more, even more preferably 380° C. or more, and even more preferably 400° C. or more.

Specific examples of the material include a fluorocarbon resin (e.g., PTFE, PFA, and FEP), a polypropylene resin (PP), a polyetheretherketone resin (PEEK), a polyimide resin, and a ceramic (e.g., alumina, aluminum nitride). These materials may be combined and molded. It is particularly preferable to use PTFE (polytetrafluoroethylene), alumina, aluminum nitride, and the like.

Excitation Gas Introducing Port

The coupling device 1 includes the "excitation gas introducing port" 2. The excitation gas introducing port is a hole that is necessary for introducing excitation gas ejected from an excitation gas ejecting port 32 of the ion source into the device.

There is no particular limitation on the shape of the excitation gas introducing port 2, and any shape can be adopted as long as the shape can be adopted as the cross-sectional shape of the channel, examples of which include a circular shape, an annular shape, an elliptic shape, a polygonal shape (e.g., a triangular shape, a quadrangular shape, a rectangular shape, a diamond shape, a pentagonal shape, and a hexagonal shape), a polygonal annular shape, a semicircular shape, a heart-like shape, and a teardrop-like shape. In particular, the circular shape and the annular shape are preferable from the viewpoint of reducing fluid resistance.

The port width of the excitation gas introducing port 2 (the width of the longest portion of the port; the inner diameter in the case where the port is circular or annular) can be set from 0.5 to 30 mm, for example.

The lower limit of the port width can be set to 0.5 mm or more, preferably 0.75 mm or more, more preferably 1 mm or more, even more preferably 1.5 mm or more, even more preferably 2 mm or more, and even more preferably 2.5 mm or more, for example.

The upper limit of the port width can be set to 30 mm or less, preferably 20 mm or less, more preferably 10 mm or less, even more preferably 8 mm or less, even more preferably 6 mm or less, even more preferably 5 mm or less, even more preferably 4 mm or less, and even more preferably 3.5 mm or less, for example.

It is preferable that in the coupling device 1, the region around the excitation gas introducing port 2 has a shape that is suitable for connection to an excitation gas ejecting nozzle 32 of the ion source (including a case where an adapter or an accessory member corresponds to the ejecting nozzle). That is, it is preferable that the shape is such that the excitation gas introducing port 2 and the tip port of the ejecting nozzle 32 can be connected to each other so as to be in contact with or close to each other.

A shape can be adopted in which the support portion of the coupling device is hollowed out toward the inside, and the excitation gas introducing port 2 is formed in the bottom of the hollowed out portion, for example. Adopting the hollowed out shape makes it easy to insert the excitation gas ejecting port 32 of the ion source into the hollowed out portion of the coupling device and connect it thereto.

Figure 1A:
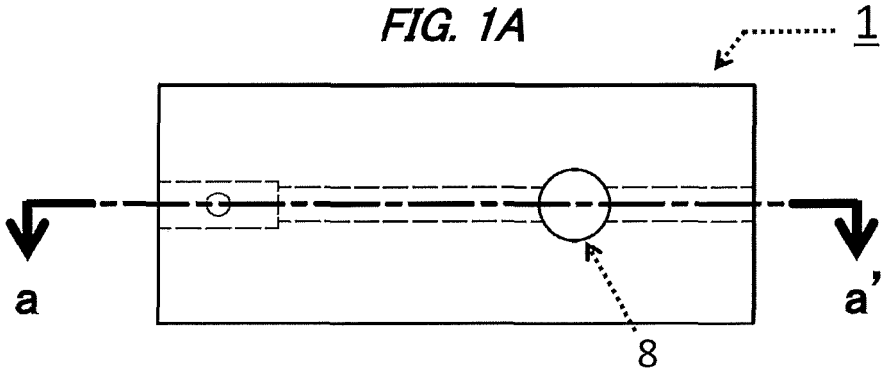
FIG. 1A is a plan view showing one mode of a sensitivity enhancing coupling device according to the present invention when viewed from the upper side. The dashed lines indicate the inner structure. The dashed-dotted line indicates a cross section taken along line a-a'.
Figure 1B:
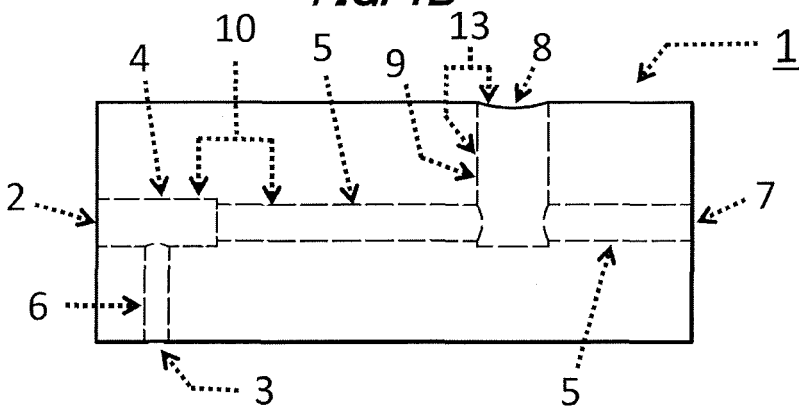
FIG. 1B is a cross-sectional view taken along line a-a' when viewed from the front side.
Figure 1C:
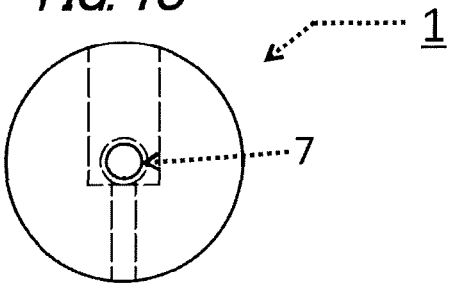
FIG. 1C is a side view when viewed from the right lateral side.
Figure 2:
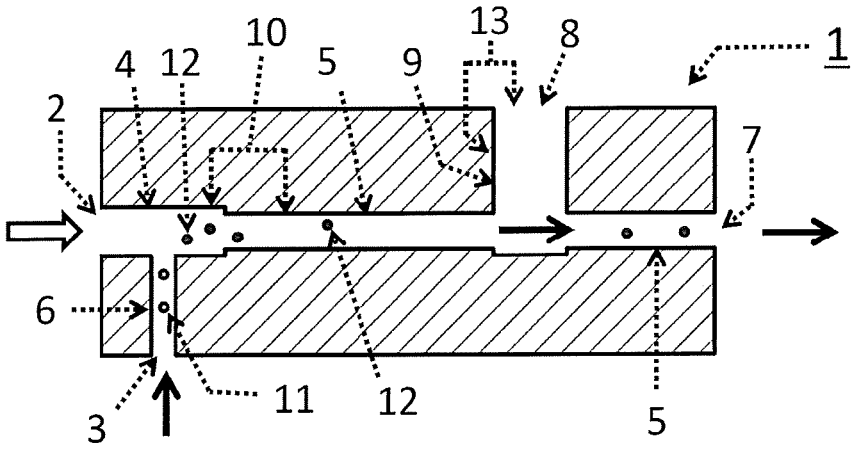
FIG. 2 is a longitudinal cross-sectional view of one mode of a sensitivity enhancing coupling device according to the present invention when viewed from the front side. The hatched regions indicate a support structure portion of the coupling device. The thick arrows shown in the diagram indicate the flow of sample gas or ionized sample gas. The hollow arrow indicates the flow of excitation gas.
Figure 3A:
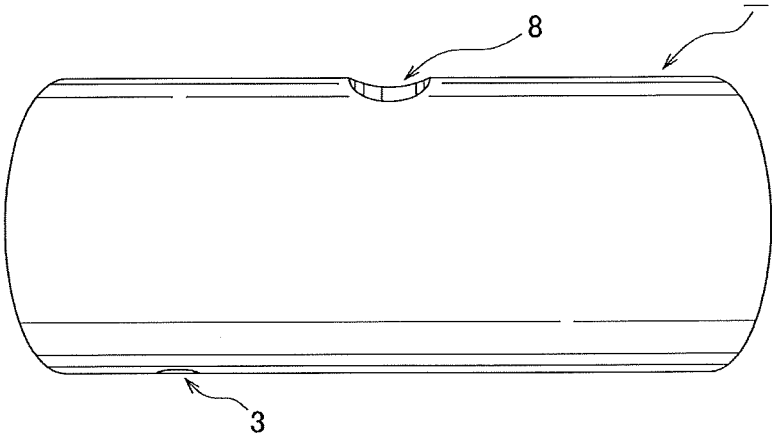
FIG. 3A is a photographic image of a sensitivity enhancing coupling device used in Examples when viewed from the front side.
Figure 3B:
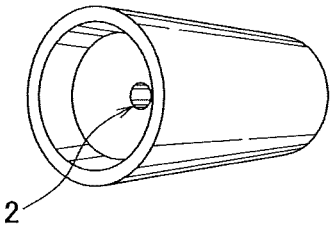
FIG. 3B is a photographic image of the coupling device when obliquely viewed from the left lateral-front side.

It should be noted that the hollowed out portion can be shaped such that its width (the inner diameter in the case where the portion is circular or annular) corresponds to the outline shape of the excitation gas ejecting port 32 (the outer diameter in the case where the port is circular or annular) (see FIG. 3B).

It is preferable that the hollowed out shape is a shape in which the hollowed out portion is formed by being hollowed out toward the inside such that its bottom has a conical curved shape or a substantially conical curved shape. Adopting such a shape makes it possible to efficiently and concentratedly introduce the excitation gas into the coupling device.

It should be noted that with regard to the position of the excitation gas introducing port 2 in the device, when the coupling device has a pillar-like shape, a substantially pillar-like shape, a tubular shape, a cylindrical shape, or the like, it is preferable to form the excitation gas introducing port 2 in the lateral surface portion of the laid-down pillar, tube, or the like. This makes it possible to obtain a shape that is suitable for securing the excitation gas-sample gas mixing space 4 and the ionized sample gas channel 5 each having a certain channel length.

Ionized Sample Gas Discharging Port

The coupling device 1 is a member characterized by including the "ionized sample gas discharging port" 7. The ionized sample gas discharging port 7 is a hole that is necessary for discharging the sample gas 12 ionized in the coupling device from the coupling device and transferring the ionized sample gas to the ionized sample gas collecting port 42 of the mass spectrometer.

There is no particular limitation on the shape of the ionized sample gas discharging port 7, and any shape can be adopted as long as the shape can be adopted as the cross-sectional shape of the channel, examples of which include a circular shape, an annular shape, an elliptic shape, a polygonal shape (e.g., a triangular shape, a quadrangular shape, a rectangular shape, a diamond shape, a pentagonal shape, and a hexagonal shape), a polygonal annular shape, a semicircular shape, a heart-like shape, and a teardrop-like shape. In particular, the circular shape and the annular shape are preferable from the viewpoint of reducing fluid resistance.

The port width of the ionized sample gas discharging port 7 (the width of the longest portion of the port; the inner diameter in the case where the port is circular or annular) can be set from 0.5 to 30 mm, for example.

The lower limit of the port width can be set to 0.5 mm or more, preferably 0.6 mm or more, more preferably 0.8 mm or more, even more preferably 1 mm or more, even more preferably 1.2 mm or more, even more preferably 1.4 mm or more, and even more preferably 1.5 mm or more, for example.

The upper limit of the port width can be set to 30 mm or less, preferably 20 mm or less, more preferably 10 mm or less, even more preferably 8 mm or less, even more preferably 6 mm or less, even more preferably 5 mm or less, even more preferably 4 mm or less, even more preferably 3 mm or less, and even more preferably 2.5 mm or less, for example.

It is preferable that in the coupling device 1, the region around the ionized sample gas discharging port 7 has a shape that is suitable for connection to the ionized sample gas collecting port 42 of the mass spectrometer (including a case where an adapter or an accessory member corresponds to the ionized sample gas collecting port). That is, it is preferable that the shape is such that the ionized sample gas discharging port 7 and the ionized sample gas collecting port 42 can be connected to each other so as to be in contact with or close to each other.

The shape can be adopted in which the support portion of the coupling device is hollowed out toward the inside, and the ionized sample gas discharging port 7 is formed in the bottom of the hollowed out portion, for example.

Adopting the hollowed out shape makes it possible to insert the ionized sample gas collecting port 42 of the mass spectrometer into the hollowed out portion of the coupling device and connect it thereto.

Figure 3C:
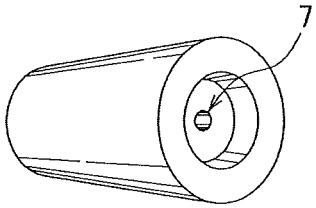
FIG. 3C is a photographic image of the coupling device when obliquely viewed from the right lateral-front side.
Figure 3D:
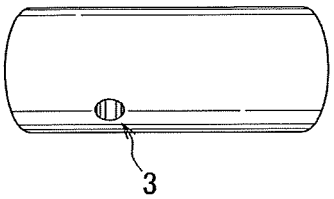
FIG. 3D is a photographic image of the coupling device when obliquely viewed from the front-bottom side.
Figure 3E:
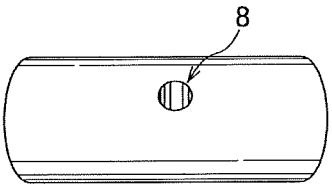
FIG. 3E is a photographic image of the coupling device when obliquely viewed from the upper-front side.

It should be noted that the hollowed out portion can be shaped such that its width (the inner diameter in the case where the portion is circular or annular) corresponds to the outline shape of the ionized sample gas collecting port 42 (the outer diameter in the case where the port is circular or annular) (see FIG. 3C).

With regard to the position of the ionized sample gas discharging port 7 in the coupling device 1, when the coupling device 1 has a pillar-like shape, a substantially pillar-like shape, a tubular shape, a cylindrical shape, or the like, it is preferable to form the ionized sample gas discharging port 7 in the lateral surface on a side opposite to the excitation gas introducing port 2. This makes it possible to obtain a shape that is suitable for securing the excitation gas-sample gas mixing space 4 and the ionized sample gas channel 5 each having a certain channel length.

Sample Gas Introducing Port

The coupling device 1 is characterized by including the "sample gas introducing port" 3. The sample gas introducing port 3 is a hole that is required for introducing a volatile substance gas 11, which is the sample gas, into the device.

There is no particular limitation on the shape of the sample gas introducing port 3, and any shape can be adopted as long as the shape can be adopted as the cross-sectional shape of the channel, examples of which include a circular shape, an annular shape, an elliptic shape, a polygonal shape (e.g., a triangular shape, a quadrangular shape, a rectangular shape, a diamond shape, a pentagonal shape, and a hexagonal shape), a polygonal annular shape, a semicircular shape, a heart-like shape, and a teardrop-like shape. In particular, the circular shape and the annular shape are preferable from the viewpoint of reducing fluid resistance.

The port width of the sample gas introducing port 3 (the width of the longest portion of the port; the inner diameter in the case where the port is circular or annular) can be set from 0.05 to 30 mm, for example.

The lower limit of the port width can be set to 0.05 mm or more, preferably 0.08 mm or more, more preferably 0.1 mm or more, even more preferably 0.2 mm or more, even more preferably 0.4 mm or more, even more preferably 0.5 mm or more, even more preferably 0.6 mm or more, even more preferably 0.8 mm or more, even more preferably 1.0 mm or more, even more preferably 1.2 mm or more, even more preferably 1.4 mm or more, and even more preferably 1.5 mm or more, for example.

The upper limit of the port width can be set to 30 mm or less, preferably 20 mm or less, more preferably 10 mm or less, even more preferably 8 mm or less, even more preferably 6 mm or less, even more preferably 5 mm or less, even more preferably 4 mm or less, even more preferably 3 mm or less, and even more preferably 2.5 mm or less, for example.

It is preferable that in the coupling device 1, the region around the sample gas introducing port 3 has a shape that is suitable for connection to the tip port of the sample gas uptake tube 51 (including a case where an adapter or an accessory member corresponds to the sample gas uptake tube). That is, it is preferable that the shape is such that the sample gas introducing port 3 and the tip port of the sample gas uptake tube 51 can be connected to each other so as to be in contact with or close to each other.

There is no particular limitation on the position of the sample gas introducing port 3 in the coupling device 1. However, when the coupling device has a pillar-like shape, a substantially pillar-like shape, a tubular shape, a cylindrical shape, or the like, it is preferable to form the sample gas introducing port 3 in a surface of the outline shape that is different from the lateral surfaces in which the excitation gas introducing port 2 and the ionized sample gas discharging port 7 are formed.

It should be noted that the sample gas introducing port 3 may be arranged at any position of the coupling device 1.

It is desirable that the sample gas introducing port 3 is formed at a position close to the excitation gas introducing port 2. It is preferable that the sample gas introducing port 3 is formed in the external surface of the outline shape of the coupling device such that the outer edge of the sample gas introducing port 3 on the excitation gas introducing port side is located within 50 mm, preferably 30 mm, more preferably 25 mm, even more preferably 20 mm, even more preferably 15 mm, even more preferably 10 mm, even more preferably 8 mm, even more preferably 6 mm, even more preferably 5 mm, and even more preferably 4 mm, from the excitation gas introducing port 2 in the direction toward the downstream side (ionized sample gas discharging port side) of the channel length of the coupling-device main channel 10.

It is preferable that the sample gas introducing port 3 is formed at a position closer to the excitation gas introducing port 2 because the ionization efficiency of the sample gas 11 can be improved.

The sample gas introducing port 3 may be arranged at any position of the coupling device 1.

In general, it is preferable that the coupling device 1 has one sample gas introducing port 3. The coupling device 1 can also be formed so as to have two or more sample gas introducing ports 3.

Coupling-Device Main Channel

The coupling device 1 has a structure in which is formed a channel through which the excitation gas introducing port 2 and the ionized sample gas discharging port 7 are in communication. This channel serves as the "coupling-device main channel" 10.

The coupling-device main channel 10 is partially constituted by the excitation gas-sample gas mixing space 4 and the ionized sample gas channel 5.

Although the coupling-device main channel 10 may have a shape including a portion having a curved-tube-like shape, a bent-tube-like shape, or an L-tube-like shape, it is preferable that at least a portion of the coupling-device main channel 10 is a channel having a linear-tube shape.

More preferably, it is optimum that the coupling-device main channel 10 is formed into a linear channel having only a linear-tube shape so that the excitation gas introducing port 2 and the ionized sample gas discharging port 7 are connected at the shortest distance and are in communication. This mode can reduce the fluid resistance of gas.

It should be noted that the structure of the coupling-device main channel 10 is substantially the same as those of the excitation gas-sample gas mixing space 4 and the ionized sample gas channel 5, and therefore, as to the specific characteristics thereof such as cross-sectional shape, channel width, and channel length, reference can be made to the characteristics described in paragraphs below in which the excitation gas-sample gas mixing space 4 and the ionized sample gas channel 5 are described.

Sample Gas Introducing Channel

The coupling device 1 includes the "sample gas introducing channel" 6 extending from the sample gas introducing port 3.

The sample gas introducing channel 6 is in communication with (connected to) the channel in the coupling-device main channel 10. Accordingly, the excitation gas-sample gas mixing space 4 is formed in the coupling-device main channel 10.

The sample gas introducing channel 6 is necessary for introducing the sample gas (volatile substance gas) 11 into the excitation gas-sample gas mixing space 4.

Although it is preferable that the sample gas introducing channel 6 has a linear-tube shape in order to reduce the fluid resistance of gas, it is also possible to adopt a sample gas introducing channel having a curved-tube-like shape, a bent-tube-like shape, an L-tube-like shape, or the like as long as the fluid resistance is not significantly affected. In addition, it is possible to adopt a tube having a shape in which the tube branches at an intermediate portion or a tube having a shape in which tubes merge.

There is no particular limitation on the shape of the cross section of the sample gas introducing channel 6, and any shape can be adopted as long as the shape can be adopted as the cross-sectional shape of the channel, examples of which include a circular shape, an annular shape, an elliptic shape, a polygonal shape (e.g., a triangular shape, a quadrangular shape, a rectangular shape, a diamond shape, a pentagonal shape, and a hexagonal shape), a polygonal annular shape, a semicircular shape, a heart-like shape, and a teardrop-like shape. In particular, a channel having a pipe shape whose cross section has a circular shape or an annular shape is preferable from the viewpoint of reducing fluid resistance.

The channel width of the sample gas introducing channel 6 (the width of the longest portion of the channel; the inner diameter in the case where the channel is circular or annular) can be set from 0.05 to 30 mm, for example.

The lower limit of the channel width can be set to 0.05 mm or more, preferably 0.08 mm or more, more preferably 0.1 mm or more, even more preferably 0.2 mm or more, even more preferably 0.4 mm or more, even more preferably 0.5 mm or more, even more preferably 0.6 mm or more, even more preferably 0.8 mm or more, even more preferably 1.0 mm or more, even more preferably 1.2 mm or more, even more preferably 1.4 mm or more, and even more preferably 1.5 mm or more, for example.

The upper limit of the channel width can be set to 30 mm or less, preferably 20 mm or less, more preferably 10 mm or less, even more preferably 8 mm or less, even more preferably 6 mm or less, even more preferably 5 mm or less, even more preferably 4 mm or less, even more preferably 3 mm or less, and even more preferably 2.5 mm or less, for example.

Although there is no particular limitation on the channel length of the sample gas introducing channel 6 in principle, it is preferable that the sample gas introducing port 3 and the coupling-device main channel 10 are in communication at the shortest distance. The channel length can be set to about 2 to 50 mm, for example.

The lower limit of the channel length can be set to 2 mm or more, preferably 3 mm or more, more preferably 4 mm or more, and even more preferably 5 mm or more, for example.

The upper limit of the channel length can be set to 50 mm or less, preferably 30 mm or less, more preferably 25 mm or less, even more preferably 20 mm or less, even more preferably 15 mm or less, and even more preferably 10 mm or less, for example.

The sample gas introducing channel 6 is in communication with the coupling-device main channel 10.

It is preferable that the portion of the coupling-device main channel 10 with which the sample gas introducing channel 6 is in communication has a linear-tube shape. If the sample gas introducing channel 6 is in communication with a portion of the channel that does not have a linear-tube shape, the gas may flow backward into the sample gas introducing channel 6, and therefore, such a configuration is undesirable.

It is desirable that the sample gas introducing channel 6 and the coupling-device main channel 10 are in communication at a position close to the excitation gas introducing port 2. It is preferable that the outer edge of the communicating portion on the excitation gas introducing port side is located within 50 mm, preferably 30 mm, more preferably 25 mm, even more preferably 20 mm, even more preferably 15 mm, even more preferably 10 mm, even more preferably 8 mm, even more preferably 6 mm, even more preferably 5 mm, and even more preferably 4 mm, from the excitation gas introducing port 2 in the direction toward the downstream side (ionized sample gas discharging port side) of the channel length of the coupling-device main channel 10.

It is preferable that the communicating position is located at a position closer to the excitation gas introducing port 2 because the ionization efficiency of the sample gas 11 can be improved.

It is preferable that the communicating (connecting) angle between the sample gas introducing channel 6 and the coupling-device main channel 10 is set to 135° or less, preferably 120° or less, more preferably 110° or less, even more preferably 100° or less, and even more preferably 90° or less, when the upstream side (excitation gas introducing direction) of the coupling-device main channel 10 with respect to the communicating position as a center indicates 0°. If the angle is overly obtuse, the gas may flow backward into the sample gas introducing channel 6, and therefore, such a configuration is undesirable.

There is no limitation on the lower limit of the communicating (connecting) angle if the communicating angle is an acute angle. Specifically, the angle is set to 10° or more, preferably 20° or more, and more preferably 30° or more, for example.

Excitation Gas-Sample Gas Mixing Space

The coupling device 1 includes the excitation gas-sample gas mixing space 4 in the region of a portion of the coupling-device main channel 10. The excitation gas-sample gas mixing space 4 is a space for mixing the excitation gas and the sample gas and is formed by the sample gas introducing channel 6 being in communication with the coupling-device main channel 10.

Since the unionized sample gas (volatile substance gas) 11 concentrates in the excitation gas-sample gas mixing space 4, the excitation gas and the sample gas are mixed in this space, thus making it possible to efficiently induce ionization of the sample gas.

The shape of the excitation gas-sample gas mixing space 4 may be any shape as long as the shape can be adopted as the cross-sectional shape of the channel, examples of which include a circular shape, an annular shape, an elliptic shape, a polygonal shape (e.g., a triangular shape, a quadrangular shape, a rectangular shape, a diamond shape, a pentagonal shape, and a hexagonal shape), a polygonal annular shape, a semicircular shape, a heart-like shape, and a teardrop-like shape. In particular, a channel space having a pipe shape whose cross section has a circular shape or an annular shape is preferable from the viewpoint of reducing fluid resistance.

It is desirable that the excitation gas-sample gas mixing space 4 is formed in a channel portion having a linear-tube shape in the coupling-device main channel 10.

It is desirable that the excitation gas-sample gas mixing space 4 is a channel space (channel) in which the sample gas 11 can concentrate efficiently, and therefore, it is preferable that the excitation gas-sample gas mixing space 4 has a certain channel width and a certain channel length.

The channel width of the excitation gas-sample gas mixing space 4 (the cross sectional width of the space: the width of the longest portion of the channel; the inner diameter in the case where the channel is circular or annular) can be set from 0.5 to 30 mm, for example, from the viewpoint that the sample gas 11 concentrates efficiently.

The lower limit of the channel width (the cross-sectional width of the space) can be set to 0.5 mm or more, preferably 0.75 mm or more, more preferably 1 mm or more, even more preferably 1.5 mm or more, even more preferably 2 mm or more, and even more preferably 2.5 mm or more, for example.

The upper limit of the channel width (the cross-sectional width of the space) can be set to 30 mm or less, preferably 20 mm or less, more preferably 10 mm or less, even more preferably 8 mm or less, even more preferably 6 mm or less, even more preferably 5 mm or less, even more preferably 4 mm or less, and even more preferably 3.5 mm or less, for example.

It is desirable that the channel length (the length of the space) of the excitation gas-sample gas mixing space 4 is set from 2 to 40 mm from the viewpoint that the sample gas 11 concentrates efficiently.

The lower limit of the channel length (the length of the space) can be set to 2 mm or more, preferably 3 mm or more, more preferably 4 mm or more, and even more preferably 4.5 mm or more, for example.

The upper limit of the channel length (the length of the space) can be set to 40 mm or less, preferably 30 mm or less, more preferably 20 mm or less, even more preferably 15 mm or less, even more preferably 12 mm or less, even more preferably 10 mm or less, even more preferably 8 mm or less, even more preferably 6 mm or less, and even more preferably 5.5 mm or less, for example.

It is desirable that the excitation gas-sample gas mixing space 4 is formed at a position close to the excitation gas introducing port 2.

It is preferable that the excitation gas-sample gas mixing space 4 is formed in a region of the coupling-device main channel 10 that has a channel length of 50 mm or less, preferably 30 mm or less, more preferably 25 mm or less, even more preferably 20 mm or less, even more preferably 15 mm or less, even more preferably 10 mm or less, even more preferably 8 mm or less, even more preferably 6 mm or less, even more preferably 5 mm or less, and even more preferably 4 mm or less, from the excitation gas introducing port 2.

It should be noted that the excitation gas-sample gas mixing space 4 can be formed at a desired position by adjusting the communicating (connecting) position and angle of the sample gas introducing channel 6.

In the present invention, in general, it is preferable that the coupling device 1 includes only one excitation gas-sample gas mixing space 4.

It should be noted that in a coupling device 1 including two or more sample gas introducing ports 3 and two or more sample gas introducing channels 6 or a coupling device 1 including one sample gas introducing port 3 and a sample gas introducing channel 6 in which the tube branches at an intermediate portion, the coupling device 1 includes two or more portions at which the sample gas introducing channel 6 and the coupling-device main channel 10 are in communication, and therefore, the coupling device 1 can be formed so as to have two or more excitation gas-sample gas mixing spaces 4.

Mode in which "Excitation Gas-Sample Gas Mixing Chamber" is Formed

In the coupling device, when the excitation gas-sample gas mixing space 4 is formed so as to be an "excitation gas-sample gas mixing chamber" (chamber-like space), the sample gas 11 can be concentrated more efficiently. This makes it possible to dramatically improve the efficiency of the ionization of the sample gas 11.

Specifically, the excitation gas-sample gas mixing chamber can be formed by forming, on the excitation gas introducing port 2 side of the coupling-device main channel 10, a space having a relatively larger cross-sectional area than the cross sectional area of a space on the ionized sample gas discharging port 7 side. Conversely, the excitation gas-sample gas mixing chamber can also be formed by forming, on the ionized sample gas discharging port 7 side, a space having a relatively smaller cross-sectional area than the cross sectional area of a space on the excitation gas introducing port 2 side.

The difference in cross-sectional area between the excitation gas-sample gas mixing space 4 and the downstream channel thereof can be set from 0.1 to 20 mm in terms of the above-mentioned channel width (the width of the space), for example.

The lower limit of this value can be set to 0.1 mm or more, preferably 0.2 mm or more, more preferably 0.3 mm or more, even more preferably 0.4 mm or more, even more preferably 0.5 mm or more, even more preferably 0.6 mm or more, even more preferably 0.7 mm or more, and even more preferably 0.8 mm or more, for example.

The upper limit of this value can be set to 20 mm or less, preferably 10 mm or less, more preferably 5 mm or less, even more preferably 4 mm or less, even more preferably 3 mm or less, even more preferably 2 mm or less, and even more preferably 1.5 mm or less, for example.

It is not preferable that the difference in the cross-sectional area is too large, because the pressure applied to the stepped portion becomes too great. Moreover, it is not preferable that the difference in the cross-sectional area is too small, because it becomes difficult to concentrate the sample gas 11.

It should be noted that it is preferable to form the channel located on the downstream side with respect to the chamber into a shape whose cross-sectional area is gradually reduced (e.g., a substantially conical curved shape) because fluid resistance can be reduced while the sample gas 11 can be concentrated.

Although it is preferable to form the "excitation gas-sample gas mixing chamber" so as to have an inner shape having a regular columnar shape (pipe shape) or cylindrical shape, it is also possible to form the "excitation gas-sample gas mixing chamber" so as to have an inner shape having a barrel shape, a prismatic shape (e.g., triangular prismatic, quadrangular prismatic, or hexagonal prismatic), a polygonal annular pillar-like shape, an entasis pillar-like shape (a pillar-like shape whose central portion bulges), a reverse entasis pillar-like shape (a pillar-like shape whose central portion is sunken), a truncated circular conical shape, a truncated pyramid-like shape (e.g., truncated triangular pyramid-like, truncated quadrangular pyramid-like, or truncated hexagonal pyramid-like), a trapezoidal pillar-like shape, a spherical shape, a cube-like shape, or the like. Shapes that are substantially equivalent to these shapes can also be included. A chamber having a shape obtained by combining the shapes listed above can also be formed.

A mode can also be adopted in which the channel on the excitation gas introducing port 2 side is formed into the "excitation gas-sample gas mixing chamber" by arranging an obstacle (forming a semi-partition) such as a valve-like object, a projecting object, a plate-like object, or a mesh-like object in the coupling-device main channel 10.

Ionized Sample Gas Channel

The channel on the downstream side (ionized sample gas discharging port side) with respect to the excitation gas-sample gas mixing space 4 in the coupling-device main channel 10 corresponds to the "ionized sample gas channel" 5. The ionized sample gas channel 5 is necessary for introducing the ionized sample gas 12 into the ionized sample gas discharging port 7.

Although it is preferable that the ionized sample gas channel 5 has a linear-tube shape in order to reduce the fluid resistance of gas, it is also possible to adopt a curved-tube-like shape, a bent-tube-like shape, an L-tube-like shape, or the like as long as the fluid resistance is not significantly affected. In addition, it is possible to adopt a tube having a shape in which the tube branches at an intermediate portion or a tube having a shape in which tubes merge.

There is no particular limitation on the shape of the cross section of the ionized sample gas channel 5, and any shape can be adopted as long as the shape can be adopted as the cross-sectional shape of the channel, examples of which include a circular shape, an annular shape, an elliptic shape, a polygonal shape (e.g., a triangular shape, a quadrangular shape, a rectangular shape, a diamond shape, a pentagonal shape, and a hexagonal shape), a polygonal annular shape, a semicircular shape, a heart-like shape, and a teardrop-like shape. In particular, a channel having a pipe shape whose cross section has a circular shape or an annular shape is preferable from the viewpoint of reducing fluid resistance.

The channel width of the ionized sample gas channel 5 (the width of the longest portion of the channel; the inner diameter in the case where the channel has a circular cross section or an annular cross section) can be set from 0.5 to 30 mm, for example.

The lower limit of the channel width can be set to 0.5 mm or more, preferably 0.6 mm or more, more preferably 0.8 mm or more, even more preferably 1 mm or more, even more preferably 1.2 mm or more, even more preferably 1.4 mm or more, and even more preferably 1.5 mm or more, for example.

The upper limit of the channel width can be set to 30 mm or less, preferably 20 mm or less, more preferably 10 mm or less, even more preferably 8 mm or less, even more preferably 6 mm or less, even more preferably 5 mm or less, even more preferably 4 mm or less, even more preferably 3 mm or less, and even more preferably 2.5 mm or less, for example.

Although there is no particular limitation on the channel length of the ionized sample gas channel 5 as long as the ionized sample gas 12 can reach the ionized sample gas collecting port 42 of the mass spectrometer in a state in which its ionization state is retained (within one second at most; preferably within 500 milliseconds), it is preferable that the ionized sample gas channel 5 is in communication at the shortest distance from the ionized sample gas discharging port 7. The channel length can be set to about 5 to 100 mm, for example.

The lower limit of the channel length can be set to 5 mm or more, preferably 6 mm or more, more preferably 8 mm or more, even more preferably 10 mm or more, even more preferably 12 mm or more, and even more preferably 15 mm or more, for example.

The upper limit of the channel length can be set to 100 mm or less, preferably 90 mm or less, more preferably 75 mm or less, even more preferably 60 mm or less, even more preferably 50 mm or less, even more preferably 40 mm or less, even more preferably 30 mm or less, and even more preferably 25 mm or less, for example.

Other Matters

The coupling device 1 can be configured, as necessary, to be additionally provided with a structure including a means for fixing the coupling device to a mass spectrometer or a fixing adapter. A structure in which a fixing hole 14 or the like is drilled is also possible, for example.

2. Outside Air Introducing Mechanism

When the coupling device 1 according to the present invention includes an "outside air introducing mechanism" 13, it is possible to further enhance the sensitivity of mass spectrometry (the peak value of a mass chromatogram).

Here, the outside air introducing mechanism 13 refers to a mechanism that is formed at a specific position in a specific structure and that is constituted by an outside air introducing port 8 and an outside air introducing channel 9.

When the coupling device 1 includes one outside air introducing mechanism 13, it is possible to significantly enhance the detection sensitivity of mass spectrometry. The coupling device having a mode including two or more outside air introducing mechanisms 13 is also included in the present invention.

The outside air introducing mechanism 13 is a structure that functions so as to introduce outside air into the coupling device. In view of stability of pressure inside and outside the member, it is preferable that the structure has a function of introducing outside air naturally into the coupling device due to negative pressure generated by fluid gas inside the ionized sample gas channel 5.

Here, "outside air" generally refers to atmospheric gas, but it is also possible to introduce purified air, nitrogen gas, helium gas, argon gas, or the like. In this case, since there are fewer impurities, a further increase in sensitivity can be expected.

It is also possible to introduce outside air as a balance gas through the outside air introducing mechanism 13 by forced pressurization instead of natural influx due to the negative pressure.

The outside air is introduced into the ionized sample gas channel 5 via the outside air introducing mechanism 13, and thus advantageous functions and effects described below are exhibited.

(i) A function of stabilizing pressure control in the coupling device and the entire apparatus is performed. This makes it possible to stabilize the flow rate and stably progress the ionization reaction of the sample gas in the excitation gas-sample gas mixing space 4.

(ii) Water molecules contained in the introduced outside air (atmospheric gas) have a function of further promoting the ionization of the sample gas. With this function, unreacted sample gas that has passed through the excitation gas-sample gas mixing space 4 can be ionized in the ionized sample gas channel 5. This function is exhibited particularly when DART is used as an ion source.

(iii) Furthermore, when an external standard substance is introduced through the outside air introducing mechanism 13, it becomes possible to easily quantify a volatile substance. This makes it possible to perform highly sensitive quantification without requiring an operation of adding an internal standard substance to the sample (pretreatment of the sample).

Outside Air Introducing Port

When the coupling device 1 is formed to include the outside air introducing mechanism 13, it is necessary to form the "outside air introducing port" 8 in the coupling device 1.

There is no particular limitation on the shape of the outside air introducing port 8 as long as the shape is suitable for introducing outside air, and any shape can be adopted as long as the shape can be adopted as the cross-sectional shape of the channel, examples of which include a circular shape, an annular shape, an elliptic shape, a polygonal shape (e.g., a triangular shape, a quadrangular shape, a rectangular shape, a diamond shape, a pentagonal shape, and a hexagonal shape), a polygonal annular shape, a semicircular shape, a heart-like shape, and a teardrop-like shape. In particular, the circular shape or the annular shape is preferable from the viewpoint of reducing fluid resistance.

The port width of the outside air introducing port 8 (the width of the longest portion of the port; the inner diameter in the case where the port is circular or annular) can be set from 0.1 to 30 mm, for example.

The lower limit of the port width can be set to 0.1 mm or more, preferably 0.5 mm or more, more preferably 1 mm or more, even more preferably 1.5 mm or more, even more preferably 2 mm or more, and even more preferably 3 mm or more, for example.

The upper limit of the port width can be set to 30 mm or less, preferably 20 mm or less, more preferably 10 mm or less, even more preferably 8 mm or less, even more preferably 6 mm or less, even more preferably 5 mm or less, and even more preferably 4.5 mm or less, for example.

There is no particular limitation on the position of the outside air introducing port 8 in the coupling device as long as the position at which the outside air introducing channel 9 and the coupling-device main channel 10 are in communication (connected) is located at a position corresponding to or on the downstream side (ionized sample gas discharging port side) with respect to the outer periphery of the excitation gas-sample gas mixing space 4.

It should be noted that when the outline shape of the coupling device 1 is a pillar-like shape, a substantially pillar-like shape, a tubular shape, a cylindrical shape, or the like, it is also preferable to form the outside air introducing port 8 in a surface of the outline shape that is different from the lateral surfaces in which the above-mentioned excitation gas introducing port 2 and ionized sample gas discharging port 7 are formed.

It should be noted that the outside air introducing port 8 may be arranged at any position of the coupling device 1.

Specifically, the outside air introducing port 8 can be formed in the surface of the outline shape corresponding to the outer periphery of the excitation gas-sample gas mixing space 4, with it being preferable that the outside air introducing port 8 is formed in the surface of the outline shape such that the outer edge of the outside air introducing port 8 on the excitation gas introducing port side is located 2.5 mm or more, preferably 5 mm or more, more preferably 7.5 mm or more, even more preferably 10 mm or more, even more preferably 15 mm or more, even more preferably 20 mm or more, even more preferably 25 mm or more, away from the outer edge on the ionized sample gas discharging port side of the position at which the sample gas introducing channel 6 and the coupling-device main channel 10 are in communication (connected) in the direction toward the downstream side (ionized sample gas discharging port side) with respect to the ionized sample gas channel 5.

It is preferable that the outside air introducing port 8 is formed at a position away from the excitation gas-sample gas mixing space 4 because the ionization efficiency of the sample gas 11 can be improved as this distance increases.

It should be noted that although there is no particular limitation on the upper limit of the distance, the upper limit can be set to 100 mm or less, preferably 90 mm or less, more preferably 80 mm or less, even more preferably 70 mm or less, even more preferably 60 mm or less, and even more preferably 50 mm or less, for example.

Outside Air Introducing Channel

When the coupling device 1 is formed to include the outside air introducing mechanism 13, it is necessary to form the "outside air introducing channel" 9, which extends from the outside air introducing port 8, in the coupling device 1.

This outside air introducing channel 9 is in communication with (connected to) the ionized sample gas channel 5. The outside air introducing channel 9 is necessary for introducing outside air (e.g., atmospheric gas) into the ionized sample gas channel 5.

Although it is preferable that the outside air introducing channel 9 has a linear-tube shape in order to reduce the fluid resistance of gas, it is also possible to adopt an outside air introducing channel having a curved-tube-like shape, a bent-tube-like shape, an L-tube-like shape, or the like as long as the fluid resistance is not significantly affected. In addition, it is possible to adopt a tube having a shape in which the tube branches at an intermediate portion or a tube having a shape in which tubes merge.

There is no particular limitation on the shape of the cross section of the outside air introducing channel 9, and any shape can be adopted as long as the shape can be adopted as the cross-sectional shape of the channel, examples of which include a circular shape, an annular shape, an elliptic shape, a polygonal shape (e.g., a triangular shape, a quadrangular shape, a rectangular shape, a diamond shape, a pentagonal shape, and a hexagonal shape), a polygonal annular shape, a semicircular shape, a heart-like shape, and a teardrop-like shape. In particular, a channel having a pipe shape whose cross section has a circular shape or an annular shape is preferable from the viewpoint of reducing fluid resistance.

The channel width of the outside air introducing channel 9 (the width of the longest portion of the channel; the inner diameter in the case where the channel is circular or annular) can be set from 0.1 to 30 mm, for example.

The lower limit of the channel width can be set to 0.1 mm or more, preferably 0.5 mm or more, more preferably 1 mm or more, even more preferably 1.5 mm or more, even more preferably 2 mm or more, even more preferably 3 mm or more, and even more preferably 3.5 mm or more, for example.

The upper limit of the channel width can be set to 30 mm or less, preferably 20 mm or less, more preferably 10 mm or less, even more preferably 8 mm or less, even more preferably 6 mm or less, even more preferably 5 mm or less, and even more preferably 4.5 mm or less, for example.

With regard to the channel length of the outside air introducing channel 9, a channel length in the case where the outside air introducing channel 9 is in communication with the coupling-device main channel at the shortest distance from the outside air introducing port 8 is preferable. The channel length can be set to about 2 to 50 mm, for example.

The lower limit of the channel length can be set to 2 mm or more, preferably 3 mm or more, more preferably 4 mm or more, and even more preferably 5 mm or more, for example.

The upper limit of the channel length can be set to 50 mm or less, preferably 30 mm or less, more preferably 25 mm or less, even more preferably 20 mm or less, even more preferably 15 mm or less, and even more preferably 10 mm or less, for example.

The outside air introducing channel 9 is in communication with the ionized sample gas channel 5.

It is preferable that the portion of the coupling-device main channel 10 with which the outside air introducing channel 9 is in communication has a linear-tube shape. If the outside air introducing channel 9 is in communication with a portion of the channel that does not have a linear-tube shape, the gas may flow backward into the outside air introducing channel 9, and therefore, such a configuration is undesirable.

It is preferable that in the portion at which the outside air introducing channel 9 and the ionized sample gas channel 5 are in communication (connected), a wall on a side opposite to the entering direction of the ionized sample gas channel 5 is formed so as to have a recessed structure. This recessed structure further improves a function of promoting the ionization of the sample gas 11.

Although the shape of the recessed structure may be formed by the wall being scooped or drilled into a dome shape, a conical curved shape, or a substantially conical curved shape, a stepped structure or a substantially stepped structure obtained by carving the surrounding wall is preferable.

It is preferable that the recessed structure is a stepped structure or a substantially stepped structure obtained by carving the wall of the ionized sample gas channel 5 by 0.1 mm or more, preferably 0.2 mm or more, more preferably 0.3 mm or more, even more preferably 0.4 mm or more, and even more preferably 0.5 mm or more.

It is preferable that the upper limit of the height of the step is 5 mm or less, preferably 4 mm or less, more preferably 3 mm or less, and even more preferably 2 mm or less.

It is preferable that the shape and the structural width of the recessed structure in a top view (planar shape and structural width) are the same as those of a channel cross section of the outside air introducing channel 9.

Although the position at which the outside air introducing channel 9 and the coupling-device main channel 10 are in communication can be located on the excitation gas-sample gas mixing space 4, it is desirable that the position is preferably located away from the excitation gas-sample gas mixing space 4 toward the downstream side.

Specifically, it is preferable that the outer edge on the upstream side (the excitation gas introducing port side) of the portion at which the outside air introducing channel 9 and the coupling-device main channel 10 are in communication is located 2.5 mm or more, preferably 5 mm or more, more preferably 7.5 mm or more, even more preferably 10 mm or more, even more preferably 15 mm or more, even more preferably 20 mm or more, even more preferably 25 mm or more, away from the outer edge on the downstream side (the ionized sample gas discharging port side) of the position at which the sample gas introducing channel 6 and the coupling-device main channel 10 are in communication in the direction of the channel length of the ionized sample gas channel 5 toward the downstream side (ionized sample gas discharging port side).

It is preferable that the communicating (connecting) position is located away from the excitation gas-sample gas mixing space 4 because the ionization efficiency of the sample gas can be improved as this distance increases.

It should be noted that although there is no particular limitation on the upper limit of the distance, the upper limit can be set to 100 mm or less, preferably 90 mm or less, more preferably 80 mm or less, even more preferably 70 mm or less, even more preferably 60 mm or less, and even more preferably 50 mm or less, for example.

It is preferable that the communicating (connecting) angle between the outside air introducing channel 9 and the ionized sample gas channel 5 is set to 135° or less, preferably 120° or less, more preferably 110° or less, even more preferably 100° or less, and even more preferably 90° or less, when the upstream side (ionized sample gas flowing direction) of the ionized sample gas channel 5 with respect to the communicating position as a center indicates 0°. If the angle is overly obtuse, the gas may flow backward into the outside air introducing channel 9, and therefore, such a configuration is undesirable.

There is no limitation on the lower limit of the communicating (connecting) angle if the communicating angle is an acute angle. Specifically, the angle is set to 10° or more, preferably 20° or more, and more preferably 30° or more, for example.

3. Atmospheric-Pressure Real-Time Mass Spectrometry Apparatus

Connecting the coupling device 1 according to the present invention to the atmospheric-pressure real-time mass spectrometry apparatus 21 makes it possible to perform real-time mass spectrometry of a volatile substance under ambient conditions with an extremely high sensitivity.

Here, the "atmospheric-pressure real-time mass spectrometry apparatus" 21 refers to a mass spectrometry apparatus that enables highly sensitive mass spectrometry in real time under ambient conditions.

Connection to Apparatus

The connection between the coupling device 1 and the atmospheric-pressure real-time mass spectrometry apparatus 21 is realized by connecting the excitation gas introducing port 2 to the excitation gas ejecting port 32 of the ion source, and connecting the ionized sample gas discharging port 7 to the ionized sample gas collecting port 42 of the mass spectrometer.

Here, it is desirable that the "connected state" is in a sealed state, but a particularly high degree of airtightness is not needed. Even a loosely connected state in which sliding occurs due to contact is included in the connection mode.

It is also possible to engage an adapter or an accessory member in the connection portion.

A mode is also possible in which the coupling device 1 according to the present invention is attached to an adapter or an accessory member 46 for device fixation in order to connect the coupling device 1 to the apparatus.

Ion Source

Any apparatus can be used as the atmospheric-pressure real-time mass spectrometry apparatus 21 as long as the apparatus uses an "ion source" 31 that enables the ionization of the sample under ambient conditions.

Any ion source can be used as the ion source 31 as long as the ion source uses a principle that enables the ionization of the sample gas 11 in a gas phase under ambient conditions. Specifically, it is preferable to use an ion source using the principle of the DART method (method of direct analysis in real time).

Furthermore, even if the ion source uses a principle of the DESI method (desorption electrospray ionization method), ESI method (electrospray ionization method), API method (atmospheric pressure ionization method), APPI method (atmospheric pressure photoionization method), APCI method (atmospheric pressure chemical ionization method), ASAP method (atmospheric pressure solid analysis probe method), MALDI method (matrix assisted laser desorption ionization method), EI method (electron ionization method), CI method (chemical ionization method), FD method (field desorption method), FAPA method (flowing atmospheric pressure afterglow method), DBD method (dielectric-barrier discharge method), ADI method (ambient desorption ionization method), HPIS method (helium plasma ion source method), or LTP method (low-temperature plasma method), such an ion source can be applied and used as the ion source as long as the sample gas 11 can be ionized under ambient conditions in those methods.

Mass Spectrometer

Any mass spectrometer can be used as the "mass spectrometer" 41 used in the mass spectrometry apparatus 21 as long as the mass spectrometer corresponds to an analysis unit of a regular mass spectrometer.

Examples thereof include a time-of-flight type (TOF type), a magnetic deflection type (magnetic sector type), a quadrupole type (Q type), an ion trap type (IT type), a Fourier-transform ion cyclotron resonance type (FT-ICR type), and an accelerator mass spectrometry type (AMS type). A tandem type in which these types are combined can also be given as an example thereof In particular, the time-of-flight type (TOF type) of these types of spectrometers can be favorably used because mass can be measured without limitation in principle and with a high sensitivity.

It is preferable that the ionized sample gas collecting tube 42 of the mass spectrometer 41 includes a heating means. It is possible to prevent the deposition of the ionized sample gas 12 on the inner wall of the ionized sample gas collecting tube 42 by keeping the inner wall in a high-temperature state. As the ionized sample gas collecting tube 42, a heat-resistant tube (made of a heat resistant resin, ceramic, or the like, for example) with a heating resistor wire (e.g., a nichrome wire) being in contact with the circumference of the tube can be used, for example.

It is preferable that a means for discharging gas other than the ionized sample gas 12 is provided on the downstream side of the ionized sample gas collecting tube 42 in the mass spectrometer 41. This discharging means enables the measurement sensitivity to be improved.

An example of the discharging means is a means for actively discharging gas other than the ionized sample gas 12 using a vacuum pump 45 to which a discharging tube 44 is connected.

Sample Gas Uptake Means

It is possible to efficiently introduce the sample gas 11 into the coupling device 1 by using the sample gas uptake tube after having connected the sample gas uptake tube 51 to the sample gas introducing port 3 of the coupling device.

It is preferable to use the sample gas uptake tube after having connected the sample gas uptake tube 51 to a container in which a sample substance is sealed (sample sealing container) 52. It is also possible to engage an adapter or an accessory member 55 in the connection portion.

Although the volatile substance gas itself can also be sealed in the container as the sample substance, it is preferable to seal a solid sample or a liquid sample containing the volatile substance, which is a measurement target, in the container and use this sealed sample as the sample substance.

When detecting a component having a low volatility, a volatilization gas introducing tube 53 is connected to the sample sealing container 52 to purge the container with a volatilization gas (i.e., a gas for use in volatilization such as helium gas, nitrogen gas, or atmospheric air), thus making it possible to promote the volatilization of the volatile component contained in the sample.

It should be noted that when the coupling device 1 according to the present invention is used, it is possible to perform real-time measurement with a slightly lower sensitivity even if the sample sealing container 52 is directly open toward a space filled with the volatile component in the sample substance without connecting the sample gas uptake tube 51 to the sample sealing container 52.

4. Mass Spectrometry Method

In the present invention, real-time mass spectrometry of the volatile substance can be performed with a significantly high sensitivity by using the atmospheric-pressure real-time mass spectrometry apparatus 21 to which the above-mentioned coupling device 1 is connected.

The coupling device 1 is a general-purpose member that can be shaped so as to be capable of being connected to any type of commercially available atmospheric-pressure real-time mass spectrometry apparatuses and thus can be easily attached to and detached from commercially available apparatuses. Therefore, highly sensitive real-time mass spectrometry can be easily realized.

The mass spectrometry method according to the present invention can be performed in accordance with a normal method of using an atmospheric-pressure real-time mass spectrometry apparatus, except that the coupling device 1 is used.

It should be noted that in this mass spectrometry method, pretreatment of the sample is not required in principle, and thus detection of the volatile substance in real time is possible.

Measurement Target (Volatile Substance)

In the mass spectrometry method, the sample to be analyzed is a volatile substance. The present invention enables highly sensitive mass spectrometry of any type of volatile substances.

Here, the "volatile substance" collectively refers to substances having vapor pressure in atmospheric air. Specifically, the "volatile substance" can be defined as a substance having partial pressure under conditions in which the substance is in contact with a cold gas in atmospheric air.

Examples thereof include substances included in products and the like in various fields such as aroma components, flavor components, and odor components contained in foods and beverages, perfume, cosmetics, and the like; pharmacological components contained in pharmaceuticals; minor components contained in pathological specimens; and coloring matter components contained in paints, coloring matters, and the like.

In addition, when the state of the analysis sample is changed, it is also possible to detect and analyze the behavior of the released volatile substance in real time. Moreover, it is possible to detect flavor release in real time when the state of the analysis sample is changed.

Introduction of Sample Gas into Coupling Device

In the mass spectrometry method, the sample gas (volatile substance gas) 11, which is the measurement target, is introduced into the excitation gas-sample gas mixing space 4 through the sample gas introducing port 3 of the coupling device 1.

The sample gas 11 can be introduced by the use of negative pressure generated by the flow of the excitation gas, but it is more efficient to actively volatilize the sample by performing a purge using a volatilization gas to introduce the sample.

Introduction of Excitation Gas into Coupling Device

In the mass spectrometry method, the excitation gas ejected from the excitation gas ejecting port 32 of the ion source is introduced into the excitation gas introducing port 2 of the coupling device 1. The excitation gas is introduced into the excitation gas-sample gas mixing space 4 directly by the flow of gas from the ion source.

Here, specific examples of the excitation gas introduced from the ion source 31 include excited helium gas, excited nitrogen gas, and excited neon. Excited helium gas is preferable.

Mixing and Ionization

When introduced into the excitation gas-sample gas mixing space 4, the sample gas and the excitation gas are mixed. This promotes the ionization of the sample gas 11.

Here, the "ionization of sample gas" refers to an ionized state 12 in which gaseous molecules of the sample (volatile substance) 11 are ionized by the interaction with the excitation gas and atmospheric components.

Moreover, with the coupling device provided with the outside air introducing mechanism 13, it is possible to further dramatically promote the ionization of the sample gas 11.

Discharge of Ionized Sample Gas

The ionized sample gas 12 is discharged through the ionized sample gas discharging port 7 of the coupling device 1 and introduced into the ionized sample gas collecting port 42 of the mass spectrometer.

Analysis and Detection

An analyzing step and a detecting step of the mass spectrometry method can be performed in accordance with a normal method of using an atmospheric-pressure real-time mass spectrometry apparatus without requiring a special operation or the like.

Method of Quantifying Volatile Substance

In the mass spectrometry method, when the coupling device 1 provided with the outside air introducing mechanism 13 is used, it is possible to highly accurately quantify the volatile substance by introducing an external standard substance through the outside air introducing mechanism 13.

The detection sensitivity is dramatically improved by the outside air introducing mechanism 13, thus enabling the highly accurate real-time quantification of the volatile substance, which is conventionally difficult.

Here, there is no particular limitation on the external standard substance to be used in quantification as long as an accurate standard curve can be made.

Field of Application

The mass spectrometry method according to the present invention enables direct monitoring of the volatile substance from the sample. Accordingly, application in various fields such as foods and beverages, perfume, cosmetics, pharmaceuticals, medical treatments, diagnoses, paints, solvents, agricultural chemicals, forensic medicine, narcotic examinations, and organic substance syntheses is anticipated.

In particular, it is anticipated that the mass spectrometry method according to the present invention will be used in fields in which volatile substances could not previously be monitored in real time, such as tests for changes in physical properties and states of foods and the like, and synthesis reaction processes and manufacturing processes of organic compounds.

EXAMPLES

Although the present invention will now be described by way of examples, the scope of the present invention is not limited to these examples.

Example 1: Mass Spectrometry Apparatus to which Sensitivity Enhancing Coupling Device is Attached The coupling device for a mass spectrometry apparatus according to the present invention was used to perform real-time analysis of a volatile substance with a DART-MS, which is an atmospheric-pressure real-time mass spectrometry apparatus.

(1) Sensitivity Enhancing Coupling Device

The sensitivity enhancing coupling device 1 used in this example is a coupling member whose outline shape is a shape of a laid-down column (with a lateral surface diameter of 15 mm and a length of 35 mm) (see FIG. 3A). It should be noted that the coupling device is made of a PTFE resin material (Teflon (registered trademark) resin material), which has good heat resistance.

Excitation Gas Introducing Port

The ion source connection side (left lateral surface side, see FIG. 3B) of the coupling device 1 has a shape that is suitable for connection to the excitation gas ejecting nozzle 32 (see FIG. 4) of the ion source. This shape is suitable for introducing the excitation gas into the coupling device.

Specifically, the ion source connection side of the coupling device 1 has a structure in which the inside of the column is hollowed to a position 4 mm away from the lateral surface end in the direction toward the mass spectrometer side (right lateral surface side) while the outer edge region having a thickness of 1 mm is left as it is. Furthermore, the central portion thereof is additionally hollowed by 3 mm (i.e., to a position 7 mm away from the lateral surface end) in the direction toward the mass spectrometer side (right lateral surface side) so as to have a substantially obtuse circular conical shape (see FIG. 3B). The excitation gas introducing port 2 (see FIG. 3B) having an inner diameter of 3 mm is drilled into the center of the substantially obtuse conical curved shape.

Excitation Gas-Sample Gas Mixing Chamber

A tube having an inner diameter of 3 mm is horizontally drilled to a position 5 mm away from the excitation gas introducing port 2 (i.e., a position 12 mm away from the end portion on the ion source connection side) in the direction toward the mass spectrometer side (right lateral surface side). The space inside this tube (a thick columnar space having an inner diameter of 3 mm and a length of 5 mm) forms the excitation gas-sample gas mixing chamber 4 (see FIGS. 1 and 2).

A linear tube (ionized sample gas channel) 5 (see FIGS. 1 and 2) having an inner diameter of 2 mm is horizontally drilled into the deeper portion with respect to the sample mixing chamber toward the mass spectrometer side (right lateral surface side).

Sample Gas Introducing Port

The sample gas introducing port 3 (see FIG. 3D) having an inner diameter of 2 mm is drilled on the lower side of the lateral surface of the column at a position 3 mm away from the excitation gas introducing port 2 (i.e., a position 10 mm away from the end portion of the ion source connection side) in the direction toward the mass spectrometer side (right lateral surface side).

A linear tube (sample gas introducing channel) 6 having an inner diameter of 2 mm is vertically drilled from the sample gas introducing port 3 in the direction toward the center of the column (in the vertical direction). This channel is in communication with the above-mentioned excitation gas-sample gas mixing chamber 4 (see FIGS. 1 and 2).

Ionized Sample Gas Discharging Port

The mass spectrometer connection side (right lateral surface side, see FIG. 3C) of the coupling device 1 has a shape that is suitable for connection to the ionized sample gas collecting tube 42 (see FIG. 4) of the mass spectrometer. The mass spectrometer connection side of the coupling device 1 has a shape in which the central portion of the lateral surface is hollowed out in a stepwise manner so as to be suitable for introducing the ionized sample into the ionized sample gas collecting tube 42 of the mass spectrometer.

Specifically, the mass spectrometer connection side of the coupling device 1 has a shape in which the central portion is hollowed out in a stepwise manner as follows: the inside of the column is hollowed out into a substantially obtuse circular conical shape to a position 2 mm away in the direction toward the ion source side (left lateral surface side) while the outer edge region of the column having a thickness of 4 mm is left as it is; the column is vertically hollowed out to a position additionally 1 mm away (i.e., to a position 3 mm away from the lateral surface end) in the same direction; and the inside of the column is hollowed out into a substantially obtuse circular conical shape to a position additionally 1 mm away (i.e., to a position 4 mm away from the lateral surface end) in the same direction.

The ionized sample gas discharging port 7 (see FIG. 3C) having an inner diameter of 2 mm is drilled into the center of the substantially obtuse conical curved shape.

The ionized sample gas channel 5 (see FIGS. 1 and 2) having an inner diameter of 2 mm is horizontally drilled from the ionized sample gas discharging port 7 in the direction toward the ion source side (left lateral surface side). This channel is in communication with the above-mentioned excitation gas-sample gas mixing chamber 4.

Outside Air Introducing Mechanism

In the coupling device, the outside air introducing port 8 (see FIG. 3E) having an inner diameter of 4 mm is drilled on the upper side of the lateral surface of the column at a position 11 mm away from the excitation gas introducing port 2 (i.e., a position 18 mm away from the end portion of the ion source side; a position 8 mm away from the center of the sample gas introducing port in the direction toward the mass spectrometer) in the direction toward the mass spectrometer (right lateral surface side).

The outside air introducing channel 9 having an inner diameter of 4 mm is vertically drilled from the outside air introducing port 8 so as to linearly extend in the direction toward the center of the column (in the vertical direction). This channel is in communication with the above-mentioned ionized sample gas channel 5 (see FIGS. 1 and 2), which is drilled in the horizontal direction.

Figure 4:
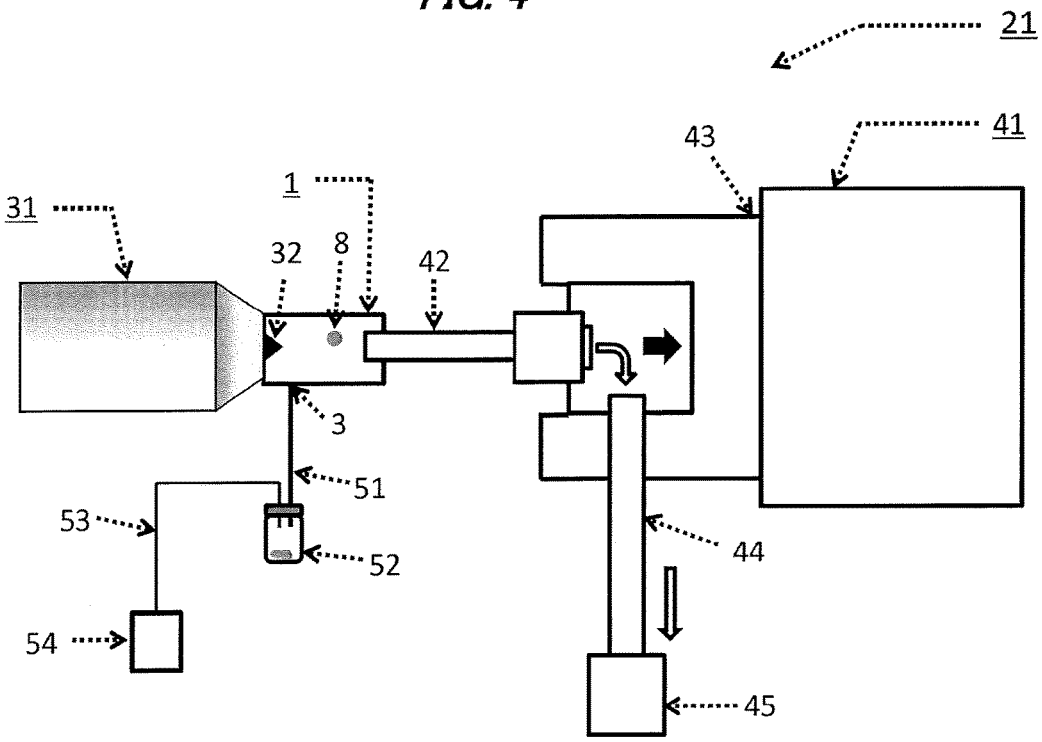
FIG. 4 is a schematic view of the structure of a DART-MS mass spectrometry apparatus to which a sensitivity enhancing coupling device used in examples is connected. The thick arrow shown in the diagram indicates the flow of ionized sample gas. The hollow arrows indicate the flow of gas other than the ionized sample gas.

(2) Mass Spectrometry Apparatus to which Sensitivity Enhancing Coupling Device is Connected The mass spectrometry apparatus 21 (see FIG. 4) used in this embodiment includes, as main components, a DART-SVP (manufactured by IonSense Inc.) as the ion source 31, a microOTO-QIII as the mass spectrometer 41, and the above-mentioned coupling device 1 (see FIG. 4).

Here, as the ionized sample gas collecting tube 42 of the mass spectrometer, a ceramic tube having an outer diameter of 6.2 mm, an inner diameter of 4.7 mm, and a length of 94 mm in which a nichrome wire (resistance heating wire) of $\phi$0.26 mm is wound around a region having a width of 35 mm from the coupling device connection side is adopted. Moreover, the discharging tube 44 is connected to the bottom surface of the mass spectrometer. The vacuum pump 45 is connected to an end of the discharging tube.

The mass spectrometry apparatus 21 has a configuration in which the sensitivity enhancing coupling device 1 is connected between the excitation gas ejecting nozzle 32 of the DART-SVP as the ion source and the ionized sample gas collecting tube 42 of the microOTO-QIII as the mass spectrometer.

A specific attachment mode of the coupling device is as shown in FIG. 4. Specifically, the excitation gas introducing port 2 (see FIGS. 1 to 3) of the coupling device is connected to an end of the excitation gas ejecting nozzle 32 on the DART-SVP side. In addition, the ionized sample gas discharging port 7 (see FIGS. 1 to 3) of the coupling device is connected to the ionized sample gas collecting tube 42 of the mass spectrometer. These connections are performed by mutually engaging the connection portions of the members in a mode where packing or the like is not engaged.

Moreover, the sample gas introducing port 3 of the coupling device is connected to a sample vial 52 via the sample gas uptake tube 51. The vial is connected to a helium gas supplying apparatus 54 via a resin tube 53.

(3) Volatile Substance (Compound to be Analyzed)

In this example, the following volatile substances were subjected to the analysis. These compounds are known as aroma components.

Cumarin ($C_9H_6O_2$, Mw=146, CAS 91-64-5, manufactured by Wako Pure Chemical Industries, Ltd.)

The structure is shown below (Formula 1). 1 mg of powder per 1.5-mL vial was subjected to an assay.

Chemical Formula 1

(Formula 1)

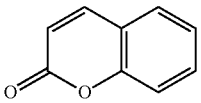

Geraniol ($C_{10}H_{18}O$, Mw=154, CAS 106-24-1, manufactured by Wako Pure Chemical Industries, Ltd.)

The structure is shown below (Formula 2). 5 mg of powder per 1.5-mL vial was subjected to an assay.

Chemical Formula 2

(Formula 2)

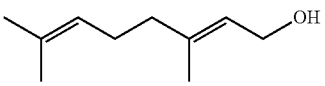

Vanillin ($C_8H_8O_3$, Mw=152, CAS 121-33-5, manufactured by Wako Pure Chemical Industries, Ltd.)

The structure is shown below (Formula 3). Compared with the above-mentioned two compounds, this compound is particularly difficult to induce the ionization and detect. 1 mg of powder per 1.5-mL vial was subjected to an assay.

Chemical Formula 3

(Formula 3)

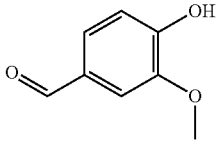

(4) Detection of Volatile Substance

The "mass spectrometry apparatus 21 to which the sensitivity enhancing coupling device is connected" (the present invention) mentioned in (2) above was used to detect the volatile substance.

Any of the volatile substances (Cumarin, Geraniol, or Vanillin) mentioned in (3) above in an amount as mentioned in (3) above was placed and sealed in the 1.5-mL sample vial 52.

A gas heater of the DART-SVP as the ion source was set to 400° C., excited helium gas was ejected from the nozzle 32 of the ion source, and the excited helium gas was introduced into the excitation gas-sample gas mixing chamber 4 (see FIGS. 1 to 3) inside the coupling device.

The sample vial 52 was purged with helium gas at a flow rate of 0.5 L/min, and the volatilized sample gas was introduced into the excitation gas-sample gas mixing chamber 4 (see FIGS. 1 to 3) inside the coupling device.

The ionized sample gas collecting tube (ceramic tube with a heating unit) 42 of the mass spectrometer 41 was heated by the application of a voltage of 25 V to prevent the ionized sample from depositing on the ionized sample gas collecting tube. Although the ionized sample gas introduced into the mass spectrometer flowed linearly as it is and was introduced into a TOF type analysis unit 43 inside the mass spectrometer, other gas (gas other than the ionized sample) was drawn and discharged by the vacuum pump 45 through the discharging tube 44, which was connected to the bottom surface of the mass spectrometer.

The analysis mode of the microOTO-QIII was set to the positive ion mode, and a mass chromatogram was obtained.

As a control, the "mass spectrometry apparatus 22 to which the coupling device is not connected" (control) mentioned above was used to perform the same analysis as mentioned above, and a mass chromatogram was obtained.

Figure 5:
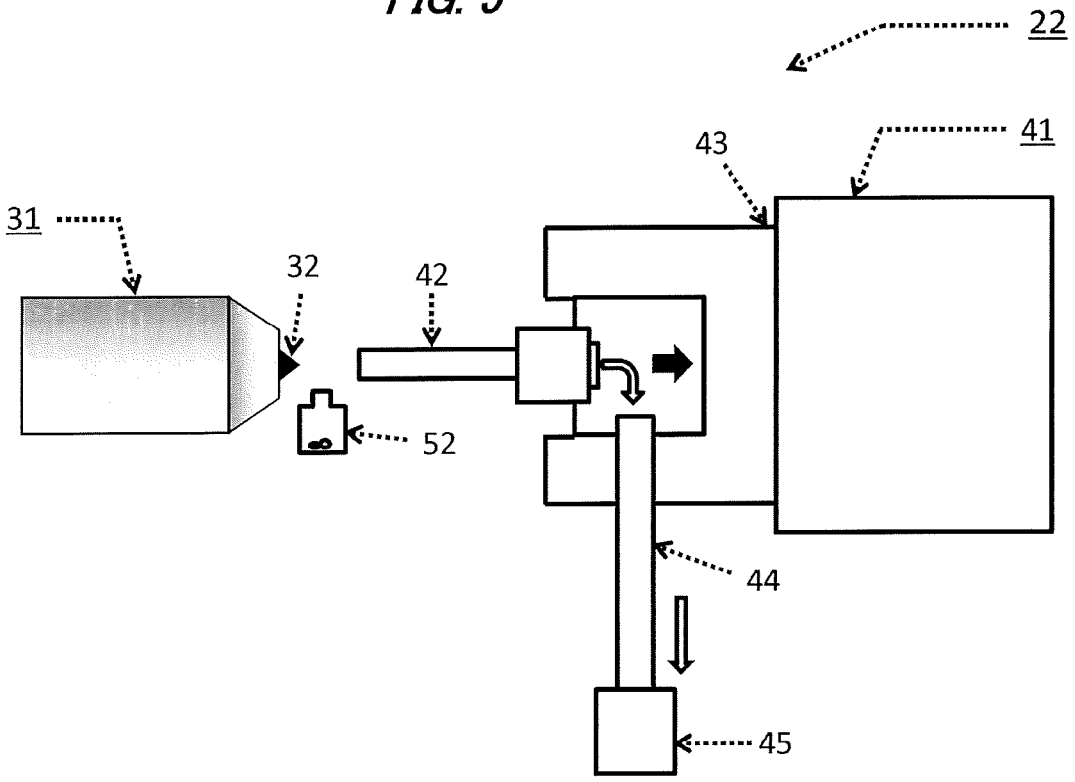
FIG. 5 is a schematic view of the structure of a DART-MS mass spectrometry apparatus used as a control in examples. The thick arrow shown in the diagram indicates the flow of ionized sample gas. The hollow arrows indicate the flow of gas other than the ionized sample gas.
Figure 6:
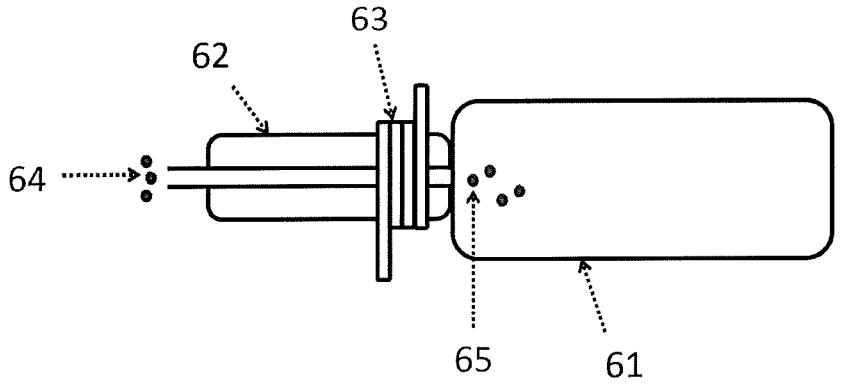
FIG. 6 is a schematic view showing a positional relationship between an interface member dedicated to a plasma mass spectrometry apparatus (ICP) and a plasma field according to Patent Document 1.

FIG. 5 shows the structure of the apparatus used as a control. Specifically, the open sample vial 52 was provided between the excitation gas ejecting nozzle 32 of the DART-SVP as the ion source and the ionized sample gas collecting tube 42 of the microOTO-QIII as the mass spectrometer, and analysis was performed as is (see FIG. 5).

Figure 7A:
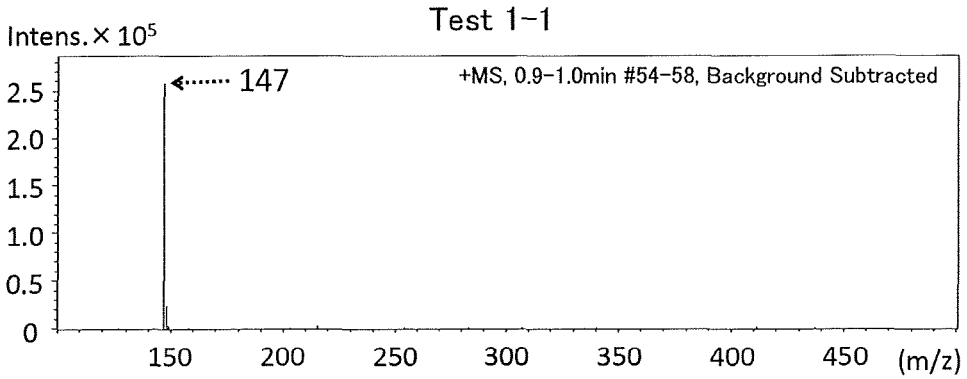
FIG. 7A is a mass chromatogram obtained by performing DART-MS mass spectrometry of Cumarin supplied as a volatile substance sample in Example 1. Specifically.
Figure 7B:
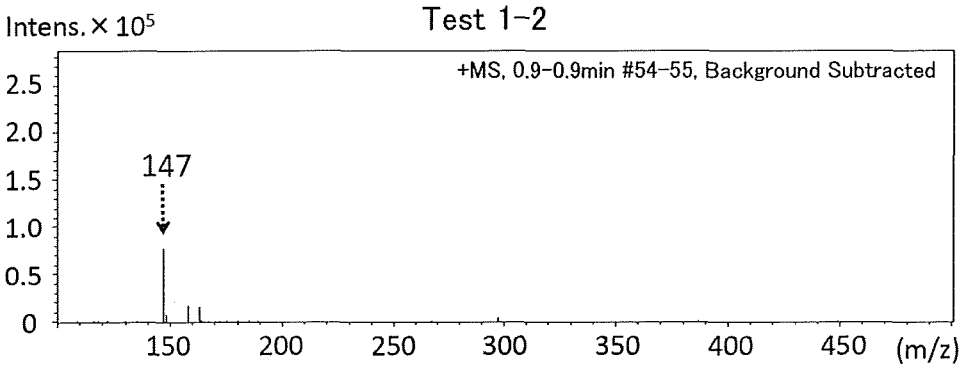
FIG. 7B is a diagram showing the result of the analysis (test 1-2) performed using the apparatus to which the coupling device is not connected in Example 1.

FIGS. 7 to 9 show the obtained mass chromatograms. Specifically, FIG. 7A shows the result of the analysis of Cumarin sealed in the sample vial using the apparatus with the coupling device (test 1-1). FIG. 7B shows the result of the analysis using the apparatus without the coupling device (test 1-2).

Figure 8A:
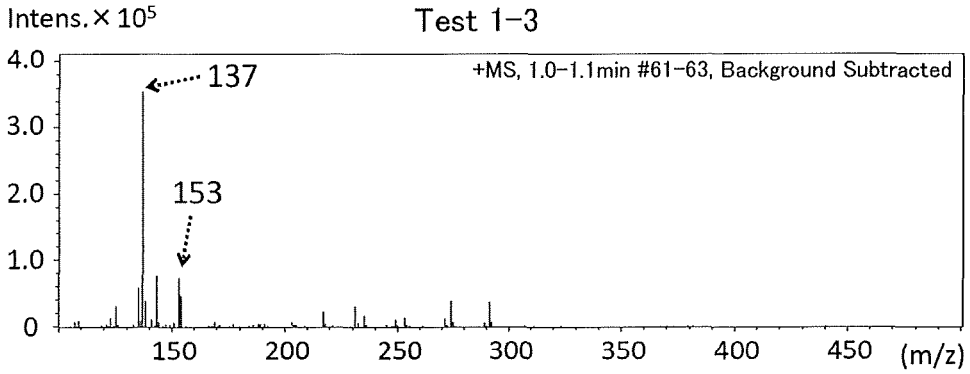
FIG. 8A is a mass chromatogram obtained by performing DART-MS mass spectrometry of Geraniol supplied as a volatile substance sample in Example 1. Specifically.
Figure 8B:
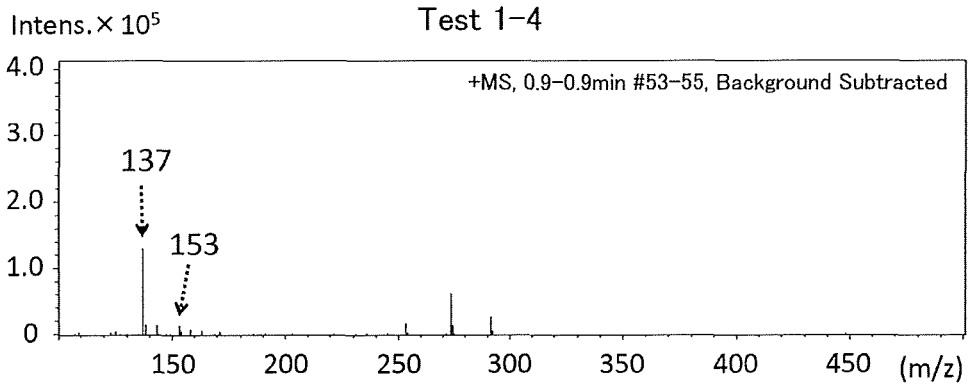
FIG. 8B is a diagram showing the result of the analysis (test 1-4) performed using the apparatus to which the coupling device is not connected in Example 1.

FIG. 8A shows the result of the analysis of Geraniol sealed in the sample vial using the apparatus with the coupling device (test 1-3). FIG. 8B shows the result of the analysis using the apparatus without the coupling device (test 1-4).

Figure 9A:
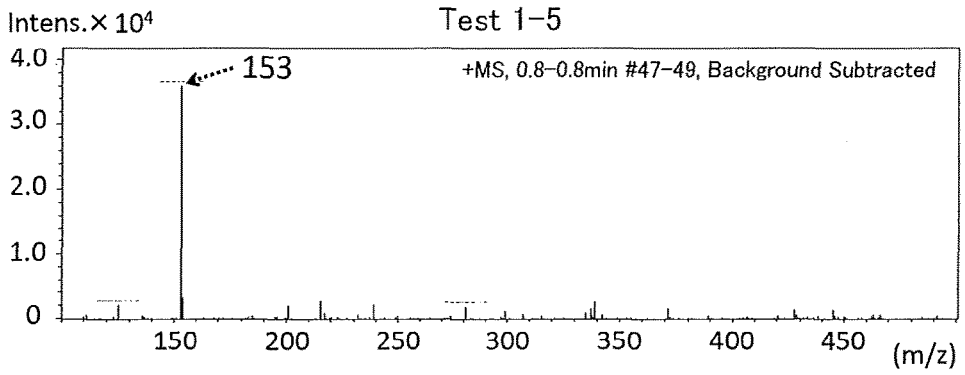
FIG. 9A is a mass chromatogram obtained by performing DART-MS mass spectrometry of Vanillin supplied as a volatile substance sample in Example 1. Specifically.
Figure 9B:
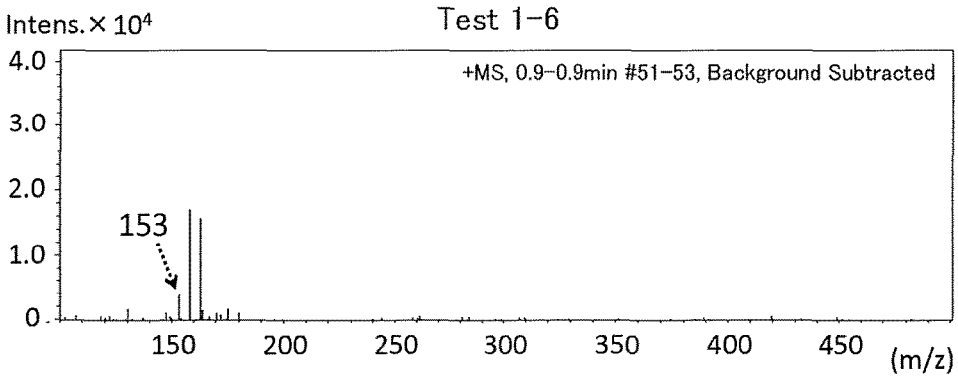
FIG. 9B is a diagram showing the result of the analysis (test 1-6) performed using the apparatus to which the coupling device is not connected in Example 1.

FIG. 9A shows the result of the analysis of Vanillin sealed in the sample vial using the apparatus with the coupling device (test 1-5). FIG. 9B shows the result of the analysis using the apparatus without the coupling device (test 1-6).

(5) Results and Discussion

It is shown from the results that when mass spectrometry was performed in the state in which the coupling device according to the present invention was connected between the DART ion source and the mass spectrometer, the intensity of the peak (the peak indicating protonation, m/z=147) originated from Cumarin increased by a factor of about 3.3 compared with the case of the apparatus (to which the coupling device was not attached) used as a control (FIG. 7A (test 1-1), FIG. 7B (test 1-2), Table 1).

With regard to the intensities of the peaks (the peak indicating dehydration and protonation, m/z=137 and the peak indicating deprotonation, m/z=153) originated from Geraniol, the peak of m/z=137 increased by a factor of about 2.8 and the peak of m/z=153 increased by a factor of about 7.0 compared with the case of the apparatus (to which the coupling device was not attached) used as a control (FIG. 8A (test 1-3), FIG. 8B (test 1-4), Table 1).

The intensity of the peak (the peak indicating dehydration and protonation, m/z=153) originated from Vanillin increased by a factor of about 9.0 compared with the case of the apparatus (to which the coupling device was not attached) used as a control (FIG. 9A (test 1-5), FIG. 9B (test 1-6), Table 1).

It is shown from these results that the coupling device according to the present invention is a member that can dramatically enhance the sensitivity of mass spectrometry (the peak value of a mass chromatogram) when connected to the atmospheric-pressure real-time mass spectrometry apparatus and used.

It is inferred that the sensitivity enhancing function is achieved by (i) concentrating unionized volatile substance gas in one place, mixing the unionized volatile substance gas with an excitation gas, and inducing ionization with high efficiency in the excitation gas-sample gas mixing chamber of the coupling device, and (ii) efficiently introducing the ionized volatile substance gas into the mass spectrometer without diffusing the gas.

TABLE 1

| Test | Sample | Coupling device | Peak originated from sample | Intensity increase rate |
|---|---|---|---|---|
| 1-1 | Cumarin 1 mg/1.5-mL vial | Yes | m/z = 147: $2.6 \times 10^5$ | 3.3 fold (m/z = 147) |
| 1-2 | Cumarin 1 mg/1.5-mL vial | No | m/z = 147: $0.8 \times 10^5$ | |
| 1-3 | Geraniol 5 mg/1.5-mL vial | Yes | m/z = 137: $3.6 \times 10^5$<br>m/z = 153: $0.7 \times 10^5$ | 2.8 fold (m/z = 137) |
| 1-4 | Geraniol 5 mg/1.5-mL vial | No | m/z = 137: $1.3 \times 10^5$<br>m/z = 153: $0.1 \times 10^5$ | 7.0 fold (m/z = 153) |
| 1-5 | Vanillin 1 mg/1.5-mL vial | Yes | m/z = 153: $3.6 \times 10^4$ | 9.0 fold (m/z = 153) |
| 1-6 | Vanillin 1 mg/1.5-mL vial | No | m/z = 153: $0.4 \times 10^4$ | |

Example 2: Functions and Effects of Outside Air Introducing Mechanism

In the coupling device for a mass spectrometry apparatus according to the present invention, functions and effects exhibited by the outside air introducing mechanism were examined.

(1) Sensitivity Enhancing Coupling Device

The coupling device produced in (1) of Example 1 was prepared as a coupling device (member 2-1) provided with the outside air introducing mechanism 13.

On the other hand, a coupling device (member 2-2) was produced that had the same structure as that of the coupling device mentioned in (1) of Example 1, except that the outside air introducing mechanism 13 was not provided. This coupling device was not provided with the outside air introducing port 8 and the outside air introducing channel 9 and thus had a structure in which the ionized sample gas channel 5 was directly connected to the ionized sample gas discharging port 7.

(2) Detection of Volatile Substance

Each of the coupling devices (member 2-1, member 2-2), which were prepared in (1) above, was connected to the mass spectrometry apparatus in the same manner as the method mentioned in (2) of Example 1. Then, the volatile substance was detected in the same manner as the method mentioned in (4) of Example 1. Vanillin ($C_8H_8O_3$, Mw=152, CAS 121-33-5, manufactured by Wako Pure Chemical Industries, Ltd.), whose ionization is particularly difficult to induce and detect, was used as the volatile substance to be detected.

The analysis was performed under the same conditions as those in (4) of Example 1, and a mass chromatogram was obtained. FIG. 10A shows the result of the analysis using the apparatus with the member 2-1 (test 2-1). FIG. 10B shows the result of the analysis using the apparatus with the member 2-2 (test 2-2).

(3) Results and Discussion

It is shown from the results that when mass spectrometry was performed in the state in which the coupling device (member 2-1) provided with the outside air introducing mechanism was connected, the value of the intensity of the peak (the peak indicating dehydration and protonation, m/z=153) originated from Vanillin was about 2.4 times higher compared with the case where the coupling device (member 2-2) provided with no outside air introducing mechanism was connected (FIG. 10A (test 2-1), FIG. 10B (test 2-2), Table 2).

It is shown from these results that when the coupling device according to the present invention is provided with the outside air introducing mechanism 13, the sensitivity of mass spectrometry (a peak value of a mass chromatogram) can be dramatically enhanced.

It should be noted that it is inferred that the sensitivity enhancing function is achieved as (i) the pressure control in the coupling device and the entire apparatus is stabilized, thus making it possible to stabilize the flow rate and allowing the ionization reaction of the sample gas in the excitation gas-sample gas mixing space 4 to proceed stably, and (ii) water molecules contained in the introduced outside air (atmospheric gas) further ionize, in the ionized sample gas channel 5, unreacted sample gas that has passed through the excitation gas-sample gas mixing space 4.

It should be noted that in view of the results of Example 1 above, the difference in signal intensity between the case where the coupling device provided with the outside air introducing mechanism was connected (test 1-5: corresponding to the member 2-1) and the case where the coupling device was not connected (test 1-6: conventional technique) was about 9.0 fold in the detection of Vanillin in test 1-5 and test 1-6.

Here, it can be seen that "about 9.0 fold", which is the difference between test 1-5 (corresponding to member 2-1) and test 1-6 (conventional technique), is significantly larger than "about 2.4 fold", which is the difference between test 2-1 (member 2-1) and test 2-2 (member 2-2) in Example 2.

It can be seen from these results that the "coupling device provided with no outside air introducing mechanism" (member 2-2) also exhibits sufficient detection sensitivity enhancing function compared with the case where no coupling device is used.

TABLE 2

| Test | Sample | Coupling device | Peak originated from sample | Intensity increase rate |
|---|---|---|---|---|
| 2-1 | Vanillin 1 mg/1.5-mL vial | With outside air introducing mechanism | m/z = 153: $2.4 \times 10^4$ | 2.4 fold (m/z = 153) |
| 2-2 | Vanillin 1 mg/1.5-mL vial | Without outside air introducing mechanism | m/z = 153: $1.0 \times 10^4$ | |

TABLE 3

| | Comparison tests | Intensity increase rate of peak originated from Vanillin (m/z = 153) |
|---|---|---|
| Test 1-5 | (coupling device provided with outside air introducing mechanism) | 9.0 fold (m/z = 153) |
| Test 1-6 | (without coupling device) | |
| Test 2-1 | (coupling device provided with outside air introducing mechanism) | 2.4 fold (m/z = 153) |
| Test 2-2 | (coupling device provided with no outside air introducing mechanism) | |

Example 3: Functions and Effects of Outside Air Introducing Mechanism

The sensitivity enhancing function of the outside air introducing mechanism shown in Example 2 was examined by extraction ion chromatogram (EIC).

(1) Sensitivity Enhancing Coupling Device

The coupling device produced in (1) of Example 1 was prepared as a "coupling device provided with an outside air introducing mechanism" (member 3-1). On the other hand, the coupling device produced in (1) of Example 2 was prepared as a "coupling device provided with no outside air introducing mechanism" (member 3-2).

(2) Extraction Ion Chromatogram

First, the "coupling device provided with no outside air introducing mechanism" (member 3-2) of the coupling devices prepared in (1) above was connected to the mass spectrometry apparatus, and Vanillin ($C_8H_8O_3$, Mw=152, CAS 121-33-5, manufactured by Wako Pure Chemical Industries, Ltd.) was detected in the same manner as the method mentioned in (4) of Example 1. After measurement was performed for 30 seconds, the coupling device was replaced with the "coupling device provided with an outside air introducing mechanism" (member 3-1), and then measurement was performed for 30 seconds.

Analysis was performed under the same conditions as those in (4) of Example 1, and a mass chromatogram showing a spectrum change focusing on m/z=153 was obtained. FIG. 11 shows the obtained mass chromatogram.

(3) Results and Discussion

It is shown from the result that the peak of m/z=153 (peak originated from Vanillin) detected while the "coupling device provided with no outside air introducing mechanism" (member 3-2) is connected is enhanced by a factor of about 2 or more by replacing the coupling device with the "coupling device provided with an outside air introducing mechanism" (member 3-1). This result of EIC supports the results of the analyses in Example 2.

Example 4: Detection of Volatile Substance from Foods

The mass spectrometry apparatus provided with the sensitivity enhancing coupling device according to the present invention was used to perform high sensitivity detection of substances volatilizing from actual commercially available foods rather than sample agents. Specifically, the difference between substances volatilizing from two types of commercially available foods was detected.

(1) Sensitivity Enhancing Coupling Device

The coupling device produced in (1) of Example 1 was prepared as a coupling device provided with the outside air introducing mechanism 13.

(2) Analysis Target

In this example, two types of chocolate were subjected to a test as analysis targets.

30 mg of commercially available dark chocolate was weighed and placed in a 1.5-mL vial, and was subjected to the assay at room temperature.

30 mg of commercially available milk chocolate was weighed and placed in a 1.5-mL vial, and was subjected to the assay at room temperature.

(3) Detection of Volatile Substance

The coupling device prepared in (1) above was connected to the mass spectrometry apparatus in the same manner as the method mentioned in (2) of Example 1. Then, the volatile substance was detected in the same manner as the method mentioned in (4) of Example 1. The chocolates mentioned in (2) above were used as analysis targets.

The analysis was performed under the same conditions as those in (4) of Example 1, and a mass chromatogram was obtained. FIG. 12A shows the result of the analysis of the dark chocolate (test 4-1). FIG. 12B shows the result of the analysis of the milk chocolate (test 4-2).

(4) Results and Discussion

It is shown from the results that when mass spectrometry was performed in the state in which the coupling device according to the present invention was connected between the DART ion source and the mass spectrometer, the difference of the volatile substances from the dark chocolate and the milk chocolate stored at room temperature can be clearly detected.

Specifically, it is shown that when the volatile components from the dark chocolate are detected, the height of the peak of m/z=153 (peak originated from Vanillin) relative to the height of the peak of m/z=137 (peak originated from Limonene and 2,3,5,6-tetramethylpyrazine) is smaller than that in the case where the volatile components from the milk chocolate are detected.

It is demonstrated from this result that mass spectrometry using the coupling device according to the present invention can be effectively used in the analysis of volatile substances contained in actual commercially available foods.

Example 5: Application 1 to Detection of Flavor Release from Foods

The state of the mouth cavity during the ingestion of foods was replicated, and changes in released volatile substances over time were measured using the mass spectrometry apparatus provided with the sensitivity enhancing coupling device according to the present invention (coupling device). In this example, spearmint chocolate was subjected to a test as an analysis target. The state of the mouth cavity was replicated, and changes in released volatile substances over time were measured.

(1) Sensitivity Enhancing Coupling Device

The coupling device produced in (1) of Example 1 was prepared as a "coupling device provided with an outside air introducing mechanism".

(2) Analysis Target

Spearmint chocolate was prepared by blending spearmint in commercially available chocolate. About 30 mg of the spearmint chocolate was weighed and placed in a 20-mL vial, and 0.5 mL of pure water was added thereto. Then, the behavior of volatile substances was analyzed in real time in a case where the spearmint chocolate was melted in a hot water bath.

(3) Extraction Ion Chromatogram

The coupling device prepared in (1) above was connected to the mass spectrometry apparatus, and background measurement was performed (measurement 5-1). Thereafter, volatile substances from the analysis sample at room temperature were measured (measurement 5-2), and then measurement was performed while the analysis sample was melted in a hot water bath (measurement 5-3). It should be noted that the series of measurement operations was continuously performed in real time.

The analysis was performed under the same conditions as those in (4) of Example 1, and mass chromatograms showing a spectrum change in TIC (total ion chromatogram), a spectrum change focusing on m/z=137 (peak originated from Limonene), and a spectrum change focusing on m/z=151 (peak originated from Carvone) were obtained. FIG. 13 shows the results.

(4) Results and Discussion

As a result, it was detected that the peak of m/z=137 (peak originated from Limonene) and the peak of m/z=151 (peak originated from Carvone) significantly increased at the same timing as the timing at which melting of the spearmint chocolate was started in the hot water bath (initial stage of measurement 5-3). Here, Limonene and Carvone are volatile compounds contained in spearmint.

It is shown from these results that with the coupling device according to the present invention, when the state of the mouth cavity is replicated, changes in volatile substances over time can be measured. That is, it is shown that flavor release can be detected in real time when the states of foods change Example 6: Application 2 to Detection of Flavor Release from Foods The state of the mouth cavity during the ingestion of foods was replicated, and changes in released volatile substances over time were measured using the mass spectrometry apparatus provided with the sensitivity enhancing coupling device according to the present invention. In this example, an orange-flavored cookie was subjected to a test as an analysis target. The state of the mouth cavity was replicated, and changes in released volatile substances over time were measured.

(1) Sensitivity Enhancing Coupling Device

The coupling device produced in (1) of Example 1 was prepared as a "coupling device provided with an outside air introducing mechanism".

(2) Analysis Target

About 0.5 g of a commercially available orange-flavored cookie was placed in a 20-mL vial as is, and then the behavior of volatile substances was analyzed in real time in a case where the cookie was crushed in the vial.

(3) Extraction Ion Chromatogram

The coupling device prepared in (1) above was connected to the mass spectrometry apparatus, and the background was measured (measurement 6-1). Thereafter, volatile substances from the analysis sample at room temperature were measured (measurement 6-2), and then measurement was performed while the cookie was crushed in the vial (measurement 6-3). It should be noted that the series of measurement operations was continuously performed in real time.

The analysis was performed under the same conditions as those in (4) of Example 1, and mass chromatograms showing a spectrum change in TIC (total ion chromatogram) and a spectrum change focusing on m/z=137 (peak originated from Limonene) were obtained. FIG. 14 shows the results.

(4) Results and Discussion

As a result, it was detected that the peak of m/z=137 (peak originated from Limonene) significantly increased at the same timing as the timing at which the orange-flavored cookie started to be crushed in the vial (initial stage of measurement 6-3). Here, Limonene is a volatile compound contained in an orange-flavored component.

It is shown from these results that with the coupling device according to the present invention, when the state of the mouth cavity is replicated, changes in volatile substances over time can be measured. That is, it is shown that flavor release can be detected in real time when the states of foods change.

Example 7: Production Examples of Sensitivity Enhancing Coupling Device

A sensitivity enhancing coupling device having a different shape from the shape of the coupling device produced in (1) of Example 1 was produced. FIG. 21A and FIG. 21B are photographic images showing the outline shape of this coupling device.

FIG. 22A and FIG. 22B are photographic images showing the state in which the coupling device is attached to an adapter member for connecting the coupling device to a mass spectrometry apparatus.

INDUSTRIAL APPLICABILITY

It is anticipated that the present invention will be applied in various fields such as foods and beverages, perfume, cosmetics, pharmaceuticals, medical treatments, diagnoses, paints, solvents, agricultural chemicals, forensic medicine, narcotic examinations, and organic substance syntheses.

In particular, it is anticipated that the present invention will be used in fields in which volatile substances could not previously be monitored in real time, such as tests for changes in physical properties and states of foods and the like, and synthesis reaction processes and manufacturing processes of organic compounds.

LIST OF REFERENCE NUMERALS

1: Sensitivity enhancing coupling device
2: Excitation gas introducing port
3: Sample gas introducing port
4: Excitation gas-sample gas mixing chamber (excitation gas-sample gas mixing space)
5: Ionized sample gas channel
6: Sample gas introducing channel
7: Ionized sample gas discharging port
8: Outside air introducing port
9: Outside air introducing channel
10: Coupling-device main channel
11: Sample gas (volatile substance gas)
12: Ionized sample gas (ionized volatile substance gas)
13: Outside air introducing mechanism
14: Device fixation hole
21: Mass spectrometry apparatus to which coupling device is connected
22: Mass spectrometry apparatus to which coupling device is not connected
31: DART-SVP (ion source)
32: Excitation gas ejecting nozzle (excitation gas ejecting port)
41: microOTO-QIII (mass spectrometer)
42: Ionized sample gas collecting tube (ionized sample gas collecting port)
43: TOF type analysis unit
44: Discharging tube
45: Vacuum pump
46: Device fixation adapter member
51: Sample gas uptake tube
52: Sample vial (sample sealing container)
53: Resin tube (volatilization gas introducing tube)
54: Helium gas supplying apparatus (volatilization gas supplying apparatus)
55: Sample gas introducing adapter member
61: Interface member dedicated to plasma mass spectrometry apparatus (ICP)
62: ICP torch
63: Plasma field
64: Solvent sample
65: Excited element sample
137: Peak of m/z=137 in mass chromatogram
147: Peak of m/z=147 in mass chromatogram
151: Peak of m/z=151 in mass chromatogram
153: Peak of m/z=153 in mass chromatogram

What is claimed is:

1. A coupling device for a mass spectrometry apparatus that is an interface member to be connected to an atmospheric-pressure real-time mass spectrometry apparatus, the coupling device comprising:

(A) an excitation gas introducing port, a sample gas introducing port, and an ionized sample gas discharging port;

(B) a channel through which the excitation gas introducing port and the ionized sample gas discharging port are in communication; and (C) a space for mixing an excitation gas and a sample gas being formed in a region of a portion of the channel recited in (B), by the coupling device having a structure in which the sample gas introducing port and the channel recited in (B) are in communication on an ionized sample gas discharging port side of the channel recited in (B) with respect to the excitation gas introducing port;

the space having a relatively larger cross-sectional area than a cross-sectional area of the channel on the ionized sample gas discharging port side;

wherein the coupling device is made of an insulating material having heat resistance; and wherein the coupling device is an interface member attachable between an excitation gas ejecting port of an ion source using a principle of a DART method and an ionized sample gas collectin port of a mass spectrometer.

2. The coupling device for a mass spectrometry apparatus according to claim 1, wherein the space recited in (C) is a space formed in a channel portion having a linear-tube shape in the channel recited in (B).

3. The coupling device for a mass spectrometry apparatus according to claim 1, wherein the space recited in (C) is a space formed such that a cross-sectional area of the channel recited in (B) on the excitation gas introducing port side is relatively large compared with the channel on the ionized sample gas discharging port side.

4. An atmospheric-pressure real-time mass spectrometry apparatus provided with the coupling device for a mass spectrometry apparatus according to claim 1.

5. A method for performing mass spectrometry of a volatile substance in real time under ambient conditions, using an atmospheric-pressure real-time mass spectrometry apparatus provided with a coupling device according to claim 1, the method comprising:

introducing a sample gas comprising the volatile substance into an excitation gas-sample gas mixing space through a sample gas introducing port;

ejecting an excitation gas from an excitation gas ejecting port of an ion source and introducing the excitation gas into an excitation gas introducing port;

mixing the sample gas and the excitation gas in the excitation gas-sample gas mixing space and promoting ionization of the sample gas; and discharging the ionized sample gas through an ionized sample gas discharging port and introducing the ionized sample gas into an ionized sample gas collecting port of the mass spectrometer.

* * * * *